US011313602B2

(12) United States Patent
Yun

(10) Patent No.: US 11,313,602 B2
(45) Date of Patent: Apr. 26, 2022

(54) REFRIGERATOR AND ICE-MAKING APPARATUS OF REFRIGERATOR

(71) Applicant: LG Electronics Inc., Seoul (KR)

(72) Inventor: Jongho Yun, Seoul (KR)

(73) Assignee: LG Electronics Inc., Seoul (KR)

( * ) Notice: Subject to any disclaimer, the term of this patent is extended or adjusted under 35 U.S.C. 154(b) by 176 days.

(21) Appl. No.: 16/130,306

(22) Filed: Sep. 13, 2018

(65) Prior Publication Data

US 2019/0078824 A1 Mar. 14, 2019

(30) Foreign Application Priority Data

Sep. 13, 2017 (KR) ..... 10-2017-0116897

(51) Int. Cl.

| | |
|---|---|
| ***F25C 1/10*** | (2006.01) |
| ***F25C 1/24*** | (2018.01) |
| ***F25C 5/187*** | (2018.01) |
| ***F25C 5/20*** | (2018.01) |
| ***F25C 5/185*** | (2018.01) |
| ***F25D 23/04*** | (2006.01) |

(52) U.S. Cl.

CPC ..... *F25C 1/10* (2013.01); *F25C 1/24* (2013.01); *F25C 5/187* (2013.01); *F25C 5/185* (2013.01); *F25C 5/22* (2018.01); *F25C 2500/02* (2013.01); *F25D 23/04* (2013.01)

(58) Field of Classification Search

CPC ..... F25C 1/04; F25C 1/10; F25C 1/24; F25C 1/25; F25C 5/187; F25C 5/22; F25C 5/185; F25C 2305/022; F25C 2500/02; F25D 23/04

See application file for complete search history.

(56) References Cited

U.S. PATENT DOCUMENTS

| | | | | |
|---|---|---|---|---|
| 4,628,699 | A * | 12/1986 | Mawby | F25C 5/185 62/137 |
| 6,161,390 | A * | 12/2000 | Kim | F25C 5/187 62/353 |
| 2005/0257536 | A1* | 11/2005 | Chung | F25C 5/187 62/135 |

(Continued)

FOREIGN PATENT DOCUMENTS

| | | |
|---|---|---|
| JP | 2014081189 | 5/2014 |
| KR | 10-2001-0051251 | 6/2001 |

OTHER PUBLICATIONS

Office Action in Korean Appln. No. 10-2017-0116897, dated Jul. 6, 2021, 39 pages (with English translation).

*Primary Examiner* — Tavia Sullens
(74) *Attorney, Agent, or Firm* — Fish & Richardson P.C.

(57) ABSTRACT

A refrigerator with an ice-making apparatus, the ice-making apparatus including: an ice tray in which ice is made; a water supply device which supplies water to the ice tray from an upper side of the ice tray; a drive unit which is coupled with the ice tray and rotates the ice tray so as to separate ice made in the ice tray; and an ice-fullness detecting lever which is coupled with the drive unit below the ice tray and is rotated in the same direction as that of the ice tray to detect ice-fullness of the ice bank, in which a tray rotation shaft for rotation of the ice tray and a lever rotation shaft for rotation of the ice-fullness detecting lever are provided in the same surface of the drive unit, and in which the lever rotation shaft is positioned below the tray rotation shaft.

14 Claims, 21 Drawing Sheets

(56) References Cited

U.S. PATENT DOCUMENTS

| | | | | |
|---|---|---|---|---|
| 2010/0175398 | A1* | 7/2010 | Lim | F25C 5/187 62/137 |
| 2013/0233010 | A1* | 9/2013 | Choi | F25C 5/187 62/340 |
| 2014/0165602 | A1* | 6/2014 | Boarman | F25C 5/187 62/3.3 |

* cited by examiner

REFRIGERATOR AND ICE-MAKING APPARATUS OF REFRIGERATOR

CROSS-REFERENCE TO RELATED APPLICATIONS

The present application claims priority under 35 U.S.C. 119 and 35 U.S.C. 365 to Korean Patent Application No. 10-2017-0116897, filed on Sep. 13, 2017, which is hereby incorporated by reference in its entirety.

BACKGROUND

The present invention relates to a refrigerator and an ice-making apparatus for a refrigerator.

A refrigerator is an appliance for storing food in a low-temperature state and has either or both of a refrigerating chamber which can store food in a refrigerated state and a freezing chamber which can store food in a frozen state.

In addition, recently, a dispenser is mounted on the front surface of the refrigerator, so that drinking water can be taken out through the dispenser without opening the refrigerator door.

In addition, an ice maker (ice-making apparatus) for making and storing ice may be provided in the door or in the storage space of the refrigerator, and ice can be taken out through the dispenser.

As the ice-making apparatus, an automatic ice maker for detecting the amount of stored ice to perform water supply, ice-making, and ice-separation has developed. The ice stored by the automatic ice maker can be taken out through the dispenser. The ice maker detects the amount of stored ice so that the ice maker can be in an ice-fullness state so that the ice can be always supplied.

Korean Patent Laid-Open Publication No. 10-2001-0051251 discloses an automatic ice-making apparatus capable of detecting the amount of stored ice by a rotating ice-checking arm and a structure is disclosed which is connected to a front surface of a drive device for rotating an ice-making dish so that the ice-checking arm can be rotated in a set cycle.

However, in such a related art, the lever-shaped ice-checking arm is positioned on the front surface of the automatic ice-making apparatus, that is, in front of the ice-making dish, and thus there is a problem that the volume in the forward and backward directions increases as much as the mounting space and the operation space of the ice-checking arm.

In such a case, in a case where the ice-making chamber in which the automatic ice-making apparatus is disposed is formed inside the door of the refrigerator, there is a problem that the automatic ice-making apparatus cannot be installed in the space inside the narrow ice-making chamber. In order to install the automatic ice-making apparatus, in a case where the space of the ice-making chamber is increased, the thickness of the door may be excessively thickened or the storage space in the refrigerator may be lost.

In addition, there is a problem in that, during an operation of the ice checking arm installed in the narrow space, when ice is separated from the ice-making dish, in a case where ice is caught between the ice-checking arm and the ice-making dish, there is a problem that detection failure occurs.

SUMMARY

An objective of the present invention is to provide an ice-making apparatus for a refrigerator and a refrigerator in which an ice-making apparatus mounted inside a door thereof has a slim structure.

An objective of the present invention is to provide a refrigerator and an ice-making apparatus for a refrigerator which prevents an increase in the volume of a door thereof and prevent a loss of a storage space inside the refrigerator.

An object of the present invention is to provide a refrigerator and an ice-making apparatus for a refrigerator which can ensure operational reliability during the ice-separation.

An object of the present invention is to provide a refrigerator and an ice-making apparatus for a refrigerator which can improve the operational reliability of ice-fullness detection.

According to an embodiment of the present invention, there is provided an ice-making apparatus for a refrigerator including: an ice tray which is provided on a door and has a plurality of shells for making ice; a water supply device which supplies water to the ice tray; an ice-fullness detecting lever which is provided below the ice tray and detects whether or not the ice which is separated from the ice tray by rotation thereof and stored is in a fullness state; and a drive unit which is coupled to the ice tray and the ice-fullness detecting lever to rotate the ice tray and the ice-fullness detecting lever, in which the drive unit has a tray rotation shaft coupled with the ice tray at a side thereof, and a lever rotation shaft which is coupled with the ice-fullness detecting lever below the tray rotation shaft, and the ice-fullness detecting lever includes a connection portion which is connected with the lever rotation shaft and extends in a direction away from the ice tray; and a detection unit which is bent at an extended end portion of the connection portion, extends along the longitudinal direction of the ice tray at a lower side of the ice tray, and is in contact with the ice of the height set by the rotation.

The ice-fullness detecting lever may be formed in a plate shape, and the width of the detection unit may be formed such that the ice-fullness detecting lever and the ice tray does not interfere with each other during the rotation operation thereof.

A portion of the connection portion which is connected with the detection unit may have a reinforcing portion which is thicker than a portion thereof connected to the lever rotation shaft.

The detection unit may be formed in a plate shape, and the inner surface of the detection unit facing the connection portion may be inclined or rounded in an up and down direction.

The distance from the ice tray to one end of the detection unit may be larger than the width of the upper end of the cell in a state where the ice-fullness detecting lever is rotated for detection.

The ice-making apparatus of a refrigerator further includes a reinforcing rib which protrudes along one end of the detection unit and starts to be in contact with the ice during the rotation of the ice-fullness detecting lever.

The drive unit may be rotated together with the ice-fullness detecting lever and the ice tray, and the ice-fullness detecting lever may start to be rotated in the same direction as that of the ice tray.

An upper end of the detection unit may be inserted into a space between an outer surface of the shell and the inner surface of the door before the rotation of the ice-fullness detecting lever starts and a lower end of the detection unit may be rotated so as to be the minimum height from the lower side of the shell during the rotation of the ice-fullness detecting lever for detecting the ice-fullness.

A tray cover which is in contact with the periphery of the ice tray, surrounds an upper side of the ice tray, and has a cool air inlet into which the cool air is introduced may be provided above the ice tray, and a lever disposition portion which extends to the lower side and has a space into which an upper end of the detection unit may be accommodated may be provided on the lower end of the tray cover.

A freezing release member which protrudes toward the ice tray may be provided on an inner surface of the detection unit facing the ice tray, and the freezing release member may be in contact with the ice tray between the shells during the rotation of the ice tray.

In a state where the ice tray is rotated by the set angle by the drive unit, the ice-fullness detecting lever may start to be rotated, and in a state where the ice-fullness detecting lever is stopped by freezing, when the ice tray is rotated by the set angle, the freezing release member and the ice tray may be in contact with each other.

The drive unit may include: a driving case in which the tray rotation shaft and the lever rotation shaft protrude; a motor inside the drive case; a plurality of transmission gears which are connected with the motor; a tray rotation gear which is connected to one side of the transmission gear and has the tray rotation shaft; a lever rotation gear in which the lever rotation shaft is formed; and a connection member which connects one side of the transmission gear and the lever rotation gear with each other, and in which the connection member may start rotation of the lever rotation gear in a state where the ice tray is rotated by a set angle.

The cell may be formed so as to be widened from a lower side toward an upper side thereof, and, in a stop state before the ice-fullness detecting lever starts the rotation thereof, at least a portion of the detection unit may be accommodated in a space between an outer surface of the shell and an inside of the door.

When the ice-fullness detecting lever is rotated, the detection unit may be rotated to the lower side of the ice tray along the outside of the ice tray at a side of the ice tray.

The lever rotation shaft may be positioned at an eccentric position with respect to the tray rotation shaft.

The door may be a freezing chamber door which opens and closes the freezing chamber.

According to an embodiment of the present invention, there is provided a refrigerator including: a cabinet in which a refrigerating chamber and a freezing chamber are formed; a refrigerating chamber door which opens and closes the refrigerating chamber; an ice-making chamber which is provided in a refrigerating chamber door to form a heat insulating space; an ice-making apparatus which is provided inside the ice-making chamber; and an ice bank which is disposed below the ice-making apparatus and in which ice made by the ice-making apparatus is stored, in which the ice-making apparatus includes an ice tray on which a plurality of shells for making ice are formed; a water supply device which supplies water to the ice tray; an ice-fullness detecting lever which is provided below the ice tray and detects whether or not the ice stored in the ice bank is in a fullness state by rotation; and a drive unit which is coupled with the ice tray and the ice-fullness detecting lever and rotates the ice tray and the ice-fullness detecting lever, and in which a tray rotation shaft coupled to the ice tray and a lever rotation shaft coupled with the ice-fullness detecting lever below the tray rotation shaft are provided in one surface of the drive unit, in which the ice-fullness detecting lever includes a connection portion which is connected to the lever rotation shaft and extends in a direction away from the ice tray; and a detection unit which is bent at an extended end portion of the connection portion and extends along the longitudinal direction of the ice tray at a lower side of the ice tray and is in contact with the ice of the height set by the rotation.

An upper end of the ice bank may extend further upward than the ice tray to cover the ice tray.

The detection unit may be formed in a plate shape and the detection unit may be disposed so that the end portion thereof faces the ice bank at a stopped state thereof, and thus the cool air passing through the ice tray may be guided so as to face the inside of the ice bank.

The ice-fullness detecting lever may be rotated inside the ice bank so as to move to the rear side toward the inside of the refrigerator from the front side adjacent to the inner surface of the ice-making chamber.

The tray rotation shaft and the lever rotation shaft may extend in parallel with each other in the same direction in a surface corresponding to the ice tray and the end portion of the ice-fullness detecting lever.

The ice-fullness detecting lever is disposed to shield between the ice-making apparatus and the ice bank in a standby state and may guide the cool air supplied for ice-making to the inside of the ice bank.

The ice-fullness detecting lever may be rotated so that one end for detecting ice is moved across the ice bank in the front and rear direction.

A reinforcing rib may be formed which is formed along one end of the detection unit in contact with the ice, protrudes in a direction intersecting the inner surface of the detection unit to reinforce the strength of the detection unit.

An auxiliary rib may be further formed which is formed along one end of the opposite side to the reinforcing rib and bent at a height lower than the height of the reinforcing rib at the end portion of the inner surface of the detection unit.

A rotation shaft of the freezing release member protrudes from both side surfaces of the freezing release member, a mounting portion on which the rotation shaft is supported is formed on the rear surface of the detection unit, in which the center of gravity of the freezing release member is positioned below and front the rotation shaft of the freezing release member, and it is possible to maintain a state where the freezing release member may be in contact with the rim portion.

The tray rotation gear may include an inner part contacting the one side of the connection member to selectively rotate the connection member, and an outer part having gear teeth coupled to the transmission gear at an outside spaced apart from the inner part.

The connection member may include: a connection member coupling portion which is rotatably and axially coupled to the transmission gear; an accommodation portion which is formed on the opposite side to the connection member coupling portion and accommodates one side of the lever rotation gear to rotate the lever rotation gear; and a contact member which is provided on the connection member so as to be in contact with the inner part and rotates the connection member.

The drive unit may further include an elastic member having one end which is connected to the lever rotation gear and the other end which is connected to the drive unit case, in which the elastic member may provide an elastic force for returning rotation of the lever rotation gear and the connection member.

The inner part may include the tray guide unit which is formed along an outer periphery of the inner part and is in contact with the contact member in a section in which the ice-fullness detecting lever is not rotated; and a lever guide unit which is recessed between both ends of the tray guide unit and in which the contact member is accommodated in a section where the ice-fullness detecting lever is rotated.

The lever guide unit may be formed in the inner part section which is before a state where the ice tray is in a vertical state from a state of being in a horizontal state.

A starting unit may be formed between the tray guide unit and the lever guide unit which further protrude outwardly to instantaneously rotate the ice-fullness detecting lever rearward and then forward upon passage of the contact member.

Both ends of the lever guide unit are formed to be inclined or rounded, and the contact member may be separated from the inner part at the center of the lever guide unit.

The following effects can be expected from the refrigerator and the ice-making apparatus of the refrigerator according to the embodiment of the present invention.

The ice-making apparatus according to the embodiment of the present invention is configured so that the rotation shaft of the ice tray and the rotation shaft of the ice-fullness detecting lever are disposed on the same surface of the drive unit. At this time, the rotation shaft of the ice-fullness detecting lever and the ice-fullness detecting lever are positioned below the ice tray, and an area rotated for detecting ice may also be provided below the ice tray.

Therefore, in the standby state or in the rotation state for detecting ice-fullness of the ice-fullness detecting lever, an additional space for the placement of the ice-fullness detecting lever is not required in the front and rear direction, and thus there is an advantage that the structure of the ice-making apparatus is remarkably slim compared to the structure in which means for detecting ice-fullness protrudes in the front and rear direction or a space is required for operation thereof.

In addition, it is possible to reduce the volume of the door due to the slim structure of the ice-making apparatus, and particularly to prevent the thickness of the ice-making chamber and the door of the refrigerating chamber from becoming thick in a case where the ice-making apparatus is provided inside the ice-making chamber formed on the door of the refrigerating door. In addition, since the ice-making apparatus is slimly configured, there is an advantage that the loss of the capacity of the storage space inside the refrigerator can be minimized.

In addition, even in a case where the ice-making apparatus is provided in the freezing chamber door, there are advantages that the freezing chamber door can be made slimmer and the loss of capacity of the storage space of the freezing chamber can be prevented.

In addition, the ice tray and the ice-fullness detecting lever may be rotated in the same direction. Accordingly, since a structure in which the ice-fullness detecting lever passes an area of the ice bank in which ice separated from the ice tray is mainly accumulated is provided, there is an advantage that ice in the ice-fullness position can be reliably detected.

In addition, since the ice-fullness detecting lever is formed in a rounded plate shape so that the ice stored in the ice bank cannot pass over or ride over the ice-fullness detecting lever, the ice-fullness detecting reliability is remarkably improved compared to the ice-fullness structure configured in a wire type.

In addition, the ice-fullness detecting lever cannot interfere with the ice tray in a state of being in standby or rotated, and ice falling from the ice tray cannot be caught and can be effectively guided downwardly along the rounded inner surface of the ice-fullness detecting lever.

In particular, the ice-fullness detecting lever has a rounded inner surface shape to effectively guide the ice falling from the ice tray to one point of the ice bank. In addition, the ice-fullness detecting lever may guide the ice while being rotated to cross at least a portion of the inside of the ice bank in the course of detecting ice-fullness, thereby preventing ice from being accumulated locally in the ice bank, and the ice inside the ice bank can be rearranged to be distributed evenly.

The ice-fullness detecting lever may have a plate-shaped structure and may be positioned in an area between the ice tray and the rear wall surface of the ice-making apparatus, particularly in a standby state. Therefore, it is possible to cause the cool air, which moves downward through the ice tray, to effectively flow into the ice bank without leaking to the outside of the ice-making apparatus. In addition, the inner surface of the ice-fullness detecting lever is formed in a round shape, and thus there is an advantage that cool air can flow into the ice bank more smoothly.

In addition, the ice-fullness detecting lever may be formed in a plate shape so that the inside surface of the ice-fullness detecting lever can be provided with a freezing release member, and even in a case where the ice-fullness detecting lever is frozen, the freezing of the ice-fullness detecting lever can be released by pushing the freezing release member while the ice tray is rotated. Such a structure can be realized by the plate-shaped ice-fullness detecting lever structure in which the freezing release member can be easily disposed, and can be realized by a structure in which the ice tray and the ice-fullness detecting lever are rotated in the same direction. Therefore, the ice-fullness detecting lever has an advantage that reliable ice-fullness detection can be performed even in a freezing state thereof.

The ice-fullness detecting lever is configured with a connection portion and a detection unit which are bent to each other, a reinforcing portion is formed on the connection portion, and a reinforcing rib and an auxiliary rib are formed at the detection unit, and the ice-fullness detecting lever configured in a plate shape is maintained in a more sturdy state, and thus there is an advantage that the consistent detection performance can be maintained and the durability can be improved.

In addition, a plurality of transmission gears, a tray rotation gear, a connection member, and a lever rotation gear are combined inside the drive unit so that the ice tray and the ice-fullness detecting lever can be rotated using a single motor, and thus there is an advantage that a more compact ice-making apparatus can be configured.

DETAILED DESCRIPTION OF THE EMBODIMENTS

Hereinafter, specific embodiments of the present invention will be described in detail with reference to the drawings. However, it should be understood that the present invention is not limited to the embodiment in which the teachings of the present invention is disclosed and that other embodiments falling within the spirit and scope of another degenerate invention or the present invention may be easily proposed by adding, changing, or deleting another component.

Figure 1:
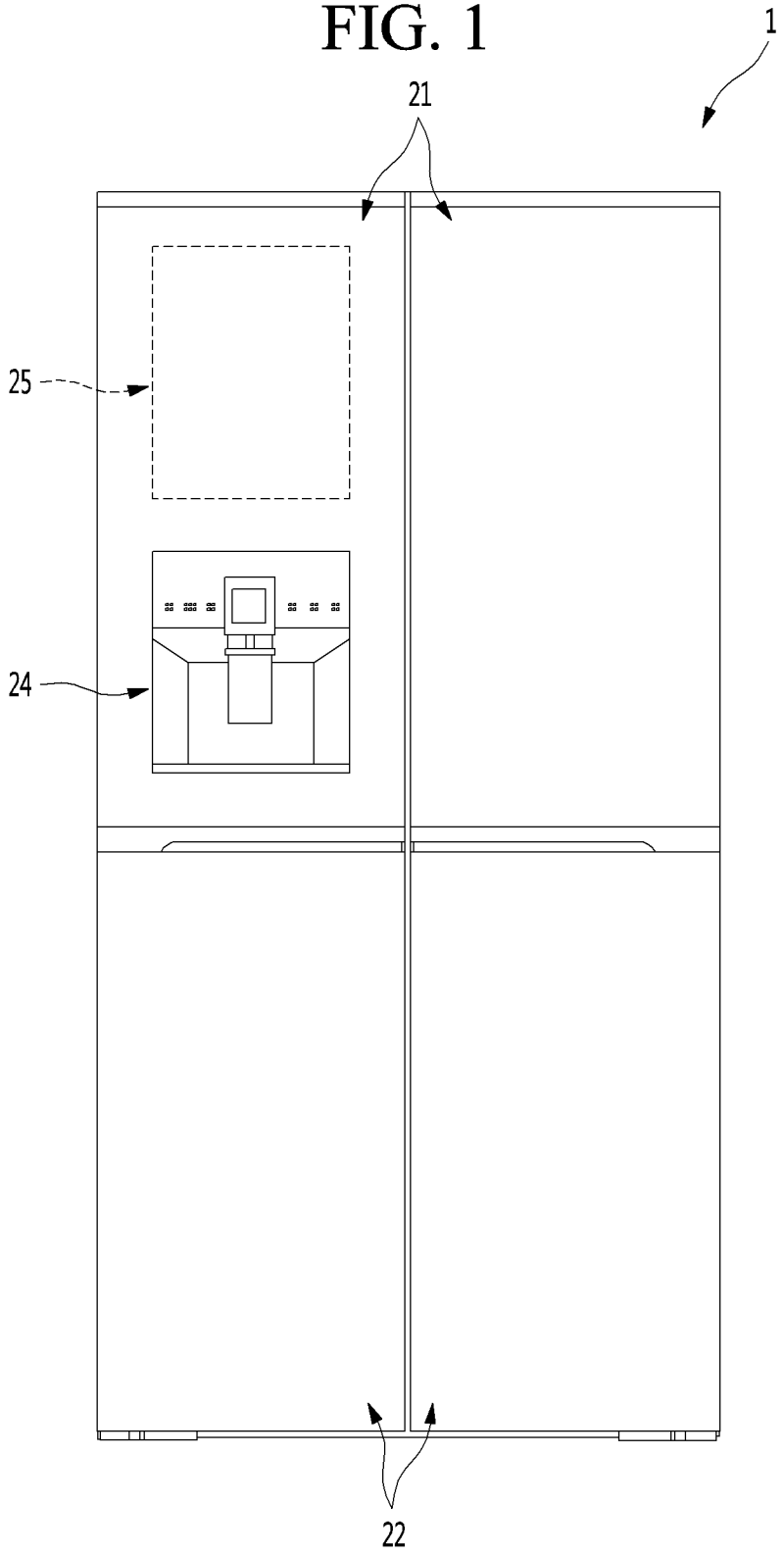
FIG. 1 is a front view illustrating a refrigerator according to an embodiment of the present invention.
Figure 2:
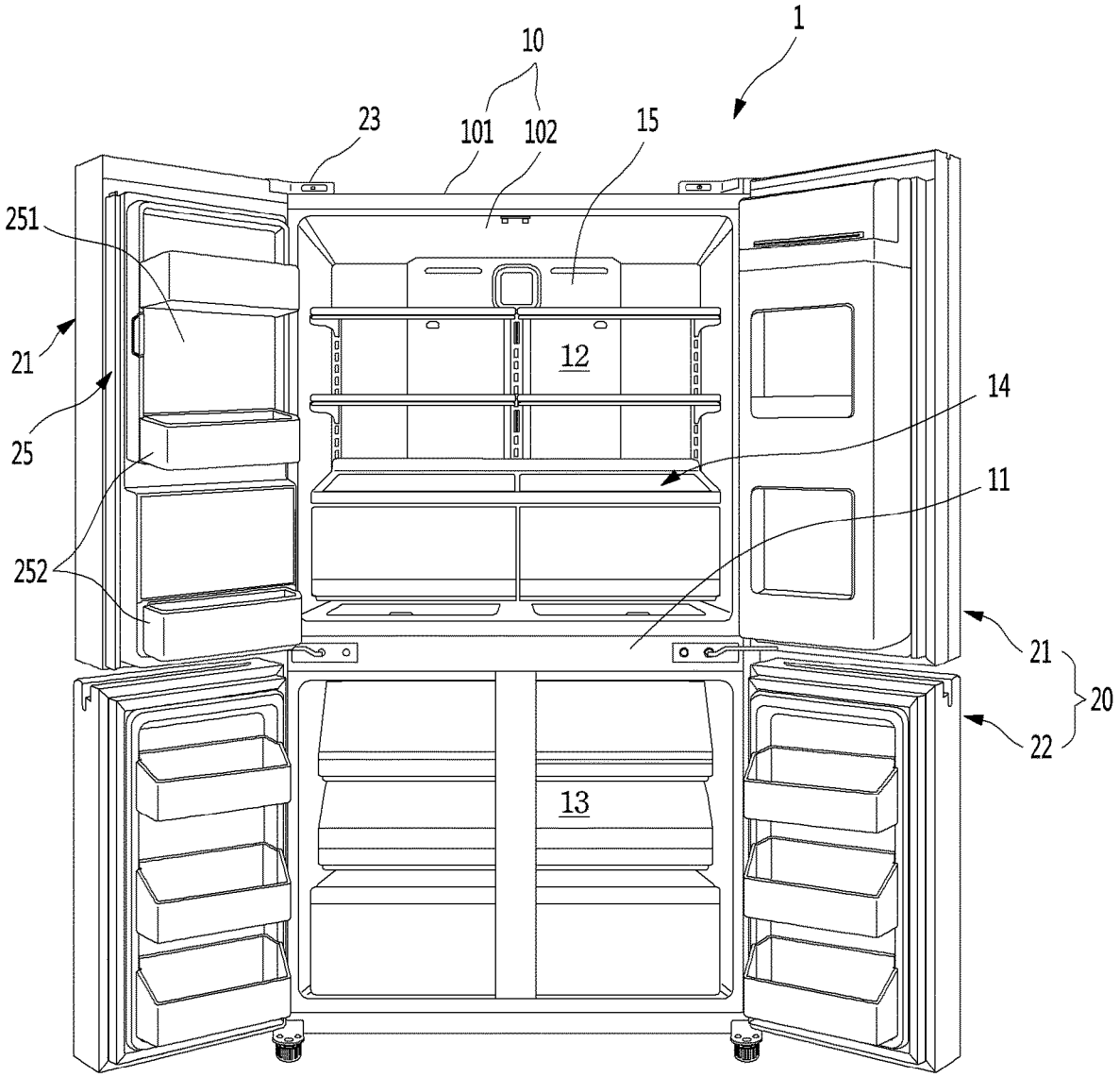
FIG. 2 is a view illustrating a state where the door of the refrigerator is opened.

FIG. 1 is a front view of a refrigerator according to an embodiment of the present invention. FIG. 2 is a view illustrating a state where the door of the refrigerator is opened.

As illustrated in the drawing, a refrigerator 1 according to an embodiment of the present invention can forms an outer appearance thereof by a cabinet 10 for forming a storage space and a door 20 for opening and closing a storage space of the cabinet 10.

The cabinet 10 may include an outer case 102 which is made of a metal material forming an outer surface; and an inner case 101 which is made of a resin material, is coupled with the outer case 102, and forms a storage space inside the refrigerator 1. The insulation material is filled between the outer case 102 and the inner case 101 to insulate the space inside the refrigerator.

The storage space is divided into upper and lower portions with respect to a barrier 11 and can include an upper refrigerating chamber 12 and a lower freezing chamber 13. In addition, the freezing chamber 13 may be further divided into right and left sides.

The door 20 may include a refrigerating chamber door and a freezing chamber door 22 that independently open and close the refrigerating chamber 12 and the freezing chamber 13, respectively. Both the refrigerating chamber door 21 and the freezing chamber door 22 have a structure capable of opening and closing the refrigerating chamber 12 and the freezing chamber 13 by the rotation thereof, and, to this end, both refrigerating chamber door 21 and the freezing chamber door 22 can be pivotally connected to the cabinet 10 by a hinge device 23. The refrigerating chamber door 21 may be configured as a French type door that can be configured to rotate independently from each other on both sides of the refrigerating chamber door 21.

A dispenser 24 and an ice-making chamber 25 may be provided in the refrigerating chamber door 21 on one side of a pair of the refrigerating chamber doors 21. The dispenser 24 and the ice-making chamber 25 may be configured to communicate with each other by an ice chute.

The dispenser 24 is provided on the front surface of the refrigerating chamber door 21 and can be configured to take out water or ice from the outside by an operation of a user. The ice-making chamber 25 is provided above the dispenser 24. The ice-making chamber 25 is a heat insulating space in which ice is made and stored, and the ice-making apparatus 30 is accommodated therein and can be configured to be opened and closed by a separate ice-making chamber door 251. Although not illustrated, the ice-making chamber 25 communicates with the freezing chamber 13 by a cool air duct (not illustrated) in a state where the refrigerating chamber door 21 is closed.

A door basket 252 for storage can be mounted on a rear surface of the ice-making chamber door 251 and below a rear surface of the refrigerating chamber door 21.

Figure 3:
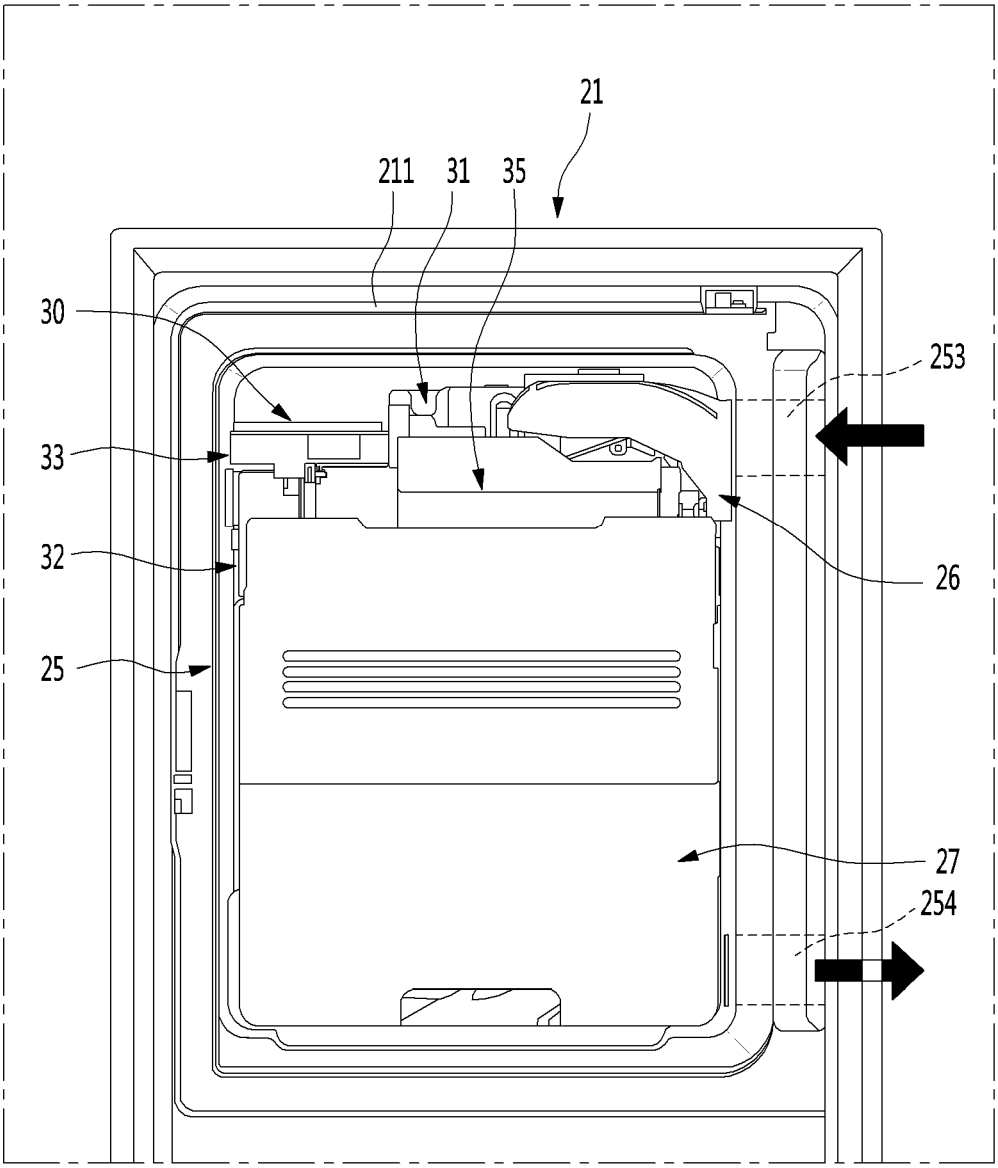
FIG. 3 is a view illustrating a state where an ice-making chamber of the door is opened.

FIG. 3 is a view illustrating a state where the ice-making chamber of the door is opened.

As illustrated in the drawing, the refrigerating chamber door 21 is formed by the coupling of an out plate which forms a front surface and a peripheral surface, and a door liner 211 which forms a rear surface, and an insulator is formed between the out plate and the door liner 211 and the refrigerating chamber door can insulate an interior space and an exterior space of the refrigerator.

In addition, the ice-making chamber 25 may be formed by the recession of the door liner 211. In other words, the door liner 211 protrudes from the periphery of the ice-making chamber 25, and a space which can accommodate an ice-making apparatus 30 and an ice bank 27 in which ice made at the ice-making apparatus is stored can be formed in a protruding space of the door liner 211.

The ice-making chamber 25 may be configured to be opened and closed by the ice-making chamber door 251 and the ice-making chamber 25 and the ice-making chamber door 251 may be thermally insulated without affecting the temperature inside the refrigerating chamber 21 so that the temperature in the ice-making chamber 25 can be maintained.

A cool air inlet 253 and a cool air outlet 254 which communicate with the cool air duct and enter cool air may be provided at one side of both side walls of the ice-making chamber 25 which is in contact with the inner wall surface of the refrigerating chamber 12 in a state where the refrigerating chamber door 21 is closed.

The cool air inlet 253 may be positioned on an upper side of the ice-making chamber 25 and the cool air outlet 254 may be positioned on a lower side of the ice-making chamber 25. The cool air inlet 253 may be configured to be positioned on a side of the ice-making apparatus 30 so that the introducing cool air passes through the ice-making apparatus 30. The cool air outlet 254 may be configured to be positioned on a side of the ice bank 27 so that the cool air passing through the ice-making apparatus 30 passes through the ice bank 27 and then passes through the cool air outlet 254, and is discharged to the outside of the ice-making chamber 25.

The ice-making apparatus 30 may be provided at an upper end of the ice-making chamber 25. The ice-making apparatus 30 is configured to be capable of automatically supplying water, ice-making, and ice-separation, and may be referred to as an auto ice maker.

The ice-making apparatus 30 may include a mounting bracket 31 for mounting the ice-making apparatus 30. The mounting bracket 31 may be fixed to the inner wall surface of the ice-making apparatus 30 by a screw and the drive unit 32 (driver) and the control box 33 of the ice-making apparatus 30 can be fixedly mounted on the mounting bracket 31.

A water supply device 26 (water supplier) may be provided on the upper end of the ice-making chamber 25. The water supply device 26 is configured to supply water for the icing to the ice-making apparatus 30 and may have a structure capable of supplying water to the ice tray 34 from above the ice tray 34.

The ice bank 27 may be provided below the ice-making apparatus 30 and may fill the remaining area of the ice-making chamber 25 below the ice-making apparatus 30. The ice bank 27 stores ice that is separated and falls from the ice-making apparatus 30, and can be connected to the dispenser 24. Therefore, the ice stored in the ice bank 27 can be discharged to the dispenser 24 when the dispenser 24 is operated.

The ice bank 27 may be configured to be detachable from the inner side of the ice-making chamber 25. Although not illustrated, an auger for supplying the stored ice to the dispenser 24 may be provided in the lower portion of the inside of the ice bank 27. The auger may be configured to supply ice by rotation and to mix the ice stored in the ice bank 27 in order not to freeze each other. In addition, the auger may include a crusher which can crush supplied ice and supply the crushed ice according to a selection of a user.

The upper end of the front surface of the ice bank 27 exposed when the ice-making chamber 25 is opened may extend upward so that the upper portion may extend to shield at least a portion of the ice-making apparatus 30 from the front.

Figure 4:
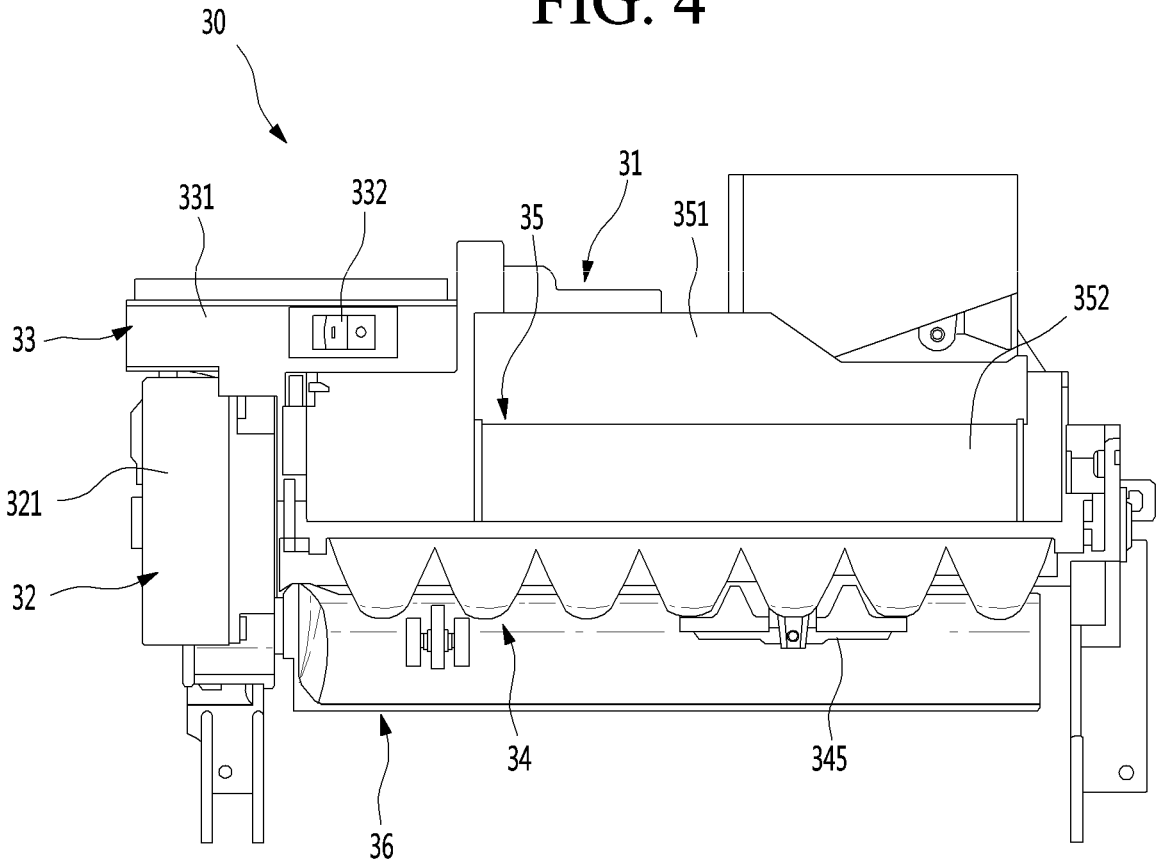
FIG. 4 is a front view illustrating the ice-making apparatus.
Figure 5:
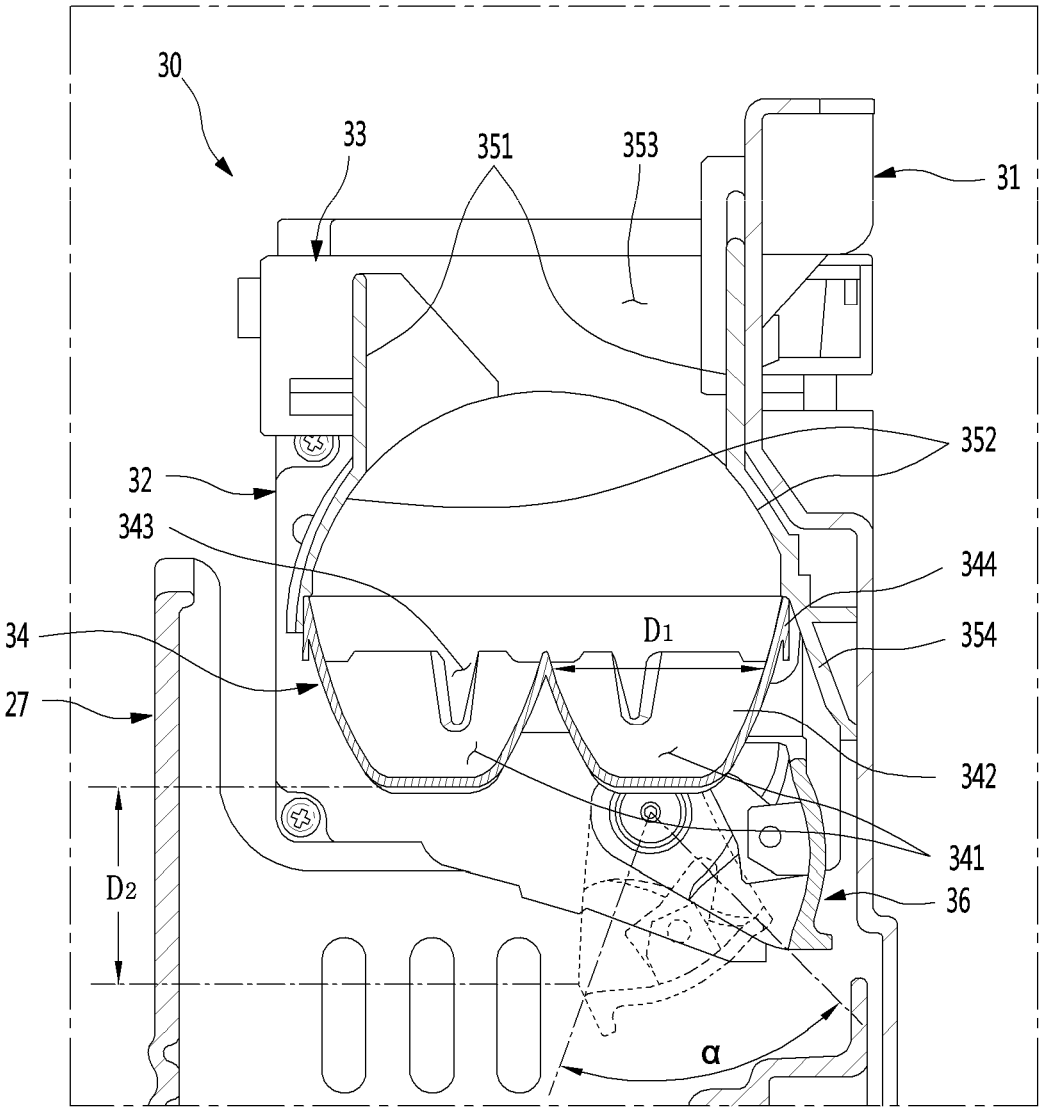
FIG. 5 is a side sectional view illustrating the ice-making apparatus.

FIG. 4 is a front view illustrating the ice-making apparatus. FIG. 5 is a side sectional view illustrating the ice-making apparatus. With reference to the drawings, the ice-making apparatus 30 will be described in more detail.

The ice-making apparatus 30 includes a mounting bracket 31 for mounting the ice-making apparatus 30, a drive unit 32 for providing power for driving the ice-making apparatus 30, an ice tray 34 which is connected to the drive unit 32, rotates, and accommodates water for make ice, a tray cover 35 which is provided above the ice tray 34 and guides cool air to the inside of the ice tray 34, an ice-fullness detecting lever 36 which is connected to the drive unit 32 to detect whether or not the ice stored in the ice bank 27 is full, and a control box 33 for controlling the operation of the drive unit 32.

Specifically, the mounting bracket 31 forms the rear surface of the ice-making apparatus 30 and may have a shape corresponding to the inner surface of the ice-making chamber 25. Therefore, the mounting bracket 31 may be in close contact with the inner wall surface of the ice-making chamber 25 and may be fixed inside the ice-making chamber 25 by a coupling member such as a screw. In addition, a cable for power supply for operating the ice-making apparatus 30 may be connected in a connector manner when the mounting bracket 31 is mounted.

The drive unit 32, the control box 33, and the tray cover 35 may be fixedly mounted on the front surface of the mounting bracket 31. The ice tray 34 may be rotatably disposed inside the tray cover 35.

The drive unit 32 provides power for rotating the ice tray 34 and the ice-fullness detecting lever 36. The drive unit 32 can be mounted on one side of the left and right sides of the mounting bracket 31. The end portions of the ice tray 34 and the ice-fullness detecting lever 36 may be mounted on one side surface of the drive unit 32 and the ice tray 34 and the lever 36 can be rotated by the operation of the drive unit 32.

The drive unit 32 may include a motor 41 and a plurality of gears in a drive unit case 321. The drive unit 32 may be configured so that the rotation of the ice tray 34 and the rotation of the ice-fullness detecting lever 36 are performed simultaneously using the one motor 41 by a combination of a plurality of gears or the like. The disposition structure of the motor 41 and the gears 42, 43 and 45 in the drive unit 32 will be described in more detail below.

The control box 33 is for controlling the operation of the drive unit 32, and a PCB can be accommodated in the control box case 331. The control box 33 may control the operation of the drive unit 32 and control the operation of the water supply unit 26 by being connected to a water supply unit 26 that supplies water to the ice tray 34. The control box may be connected to the temperature sensor 345 provided in the ice-making apparatus 30 to determine whether or not the ice-making has completed by the ice-making apparatus 30. In addition, the control box can store various information on the operation of the ice-making apparatus 30 and transmit information to a main controller (not illustrated) or a display on the dispenser 24 provided in the main body to refer to the entire operation of the refrigerator 1 or it may be displayed as an external display. The control box 33 is provided with a switch 332 so that the ice-making apparatus 30 can be operated to be selectively activated.

The ice tray 34 accommodates water for ice-making and may be formed of a resin material of a plastic material. The ice made in the ice tray 34 falls toward the lower side and is separated in a state where the ice tray is rotated, the ice tray 34 made of a plastic material is rotated by an angle that is set to face downward, and then twist occurs to separate ice from the ice tray 34. The ice-making apparatus 30 may be referred to as a twisting type ice maker because of such a separation manner.

One end of the ice tray 34 may be axially coupled to the drive unit 32 and rotated. A plurality of cells 341 may be divided in the ice tray 34, and cells 341 of the same size may be continuously disposed in two rows as illustrated in the drawing. Water may be filled in each of the cells 341 and a passage 343 is cut between the partitions 342 dividing each of the cells 341 so that even if water is supplied to one side of the ice tray 34, the water can be uniformly supplied to the entire cells 341.

A rim portion 344 may be formed on the upper end of the ice tray 34. The rim portion 344 forms the periphery of the upper end of the ice tray 34 and may extend upward to be in contact with the lower end of the tray cover 35.

The rim portion 344 may be in close contact with the lower end of the tray cover 35, prevent water overflow of the ice tray 34, and allow cool air to be held to a side of the ice tray 34 so that ice-making can be performed more smoothly.

In addition, the rim portion 344 may be configured to contact the freezing release member 37 provided on the ice-fullness detecting lever 36 when the ice tray 34 rotates.

The tray cover 35 may be positioned above the ice tray 34. The tray cover 35 guides the cool air flowing into the ice-making chamber 25 to be concentrated toward the ice tray 34 and at the same time it is prevented that water splashes and goes to the outside of the ice tray 34 when water is supplied to the ice tray 34.

The tray cover 35 may be fixedly mounted on the mounting bracket 31 and may be configured to shield the ice tray 34 from above. A cool air inlet 353 may be opened at the center of the tray cover 35 and the cool air inlet 353 may extend from one end to the other end of the ice tray 34.

The tray cover 35 may be formed on both left and right sides with respect to the cool air inlet 353 and the tray cover 35 may include a cover upper portion 351 and a cover lower portion 352. The cover upper portion 351 may be formed vertically in the up and down direction, and the extended upper end may form the cool air inlet 353. In other words, the cover portion 351 may be positioned above the inner side of the ice tray 34. The lower cover 352 may extend roundly from the lower end of the cover upper portion 351 to the upper end of the outside of the ice tray 34.

At this time, the curvature of the cover lower portion 352 may correspond to the trajectory of the outer end of the ice tray 34 when the ice tray 34 is rotated. With this structure, all of the cool air introduced into the tray cover 35 can flow toward the ice tray 34 and thus ice-making can be effectively performed, and at the same time, the water in the ice tray 34 can be prevented from overflowing to the outside. In addition, the cover lower portion 352 can be prevented from interfering by the tray cover 35 when the ice tray 34 is rotated.

A lever disposition portion 354 may be formed in the lower portion 352 of the cover 352 adjacent to the mounting bracket 31. The lever disposition portion 354 may be further extended downward from the lower end of the cover lower portion 352 and may be inclined toward the mounting bracket 31. Accordingly, the lever disposition portion 354 can be spaced apart from the outer surface of the ice tray 34 and provide a space for accommodating at least a portion of the ice-fullness detecting lever 36. At the same time, the ice tray 34 has a structure in which the shape of the cell 341 widens from the lower side toward the upper side, and the shape of the outer surface of the ice tray 34 also protrudes outward from the lower side toward the upper side. Therefore, when the ice-fullness detecting lever 36 is rotated, the ice-fullness detecting lever 36 does not interfere and a portion of the upper portion of the ice-fullness detecting lever 36 can be accommodated in a space formed by the outer surface of the ice tray 34 and the lever disposition portion 354.

Meanwhile, the ice-fullness detecting lever 36 may be coupled to the drive unit 32 and rotated. At this time, the position of the rotation shaft of the ice-fullness detecting lever 36 may be lower than the position of the rotation shaft of the ice tray 34, and may be disposed toward the inside surface (right side surface in FIG. 5) of the ice-making chamber 25 compared to the position of the rotation shaft of the ice tray 34.

The ice-fullness detecting lever 36 does not protrude in the front and rear direction (left side and right side in FIG. 5) of the ice-making apparatus 30 in the standby state or the operating state, and, in the operating state, ice can be effectively detected at the ice-fullness position of the lower portion of the ice tray 34. Therefore, the width size of the ice-making apparatus 30 in the front and rear direction is not affected by the ice-fullness detecting lever 36, and a slim structure can be achieved according to the width of the ice tray 34.

In addition, the ice-fullness detecting lever 36 is configured so as not to interfere with the ice tray 34 or be caught with ice when the ice tray 34 is rotated, and thus it is preferable that the ice-fullness detecting lever 36 is formed at a position offset to one side of the lower side of the ice tray 34.

At this time, in the structure of this embodiment in which the ice tray 34 rotates in a clockwise direction for ice-separation, the ice-fullness detecting lever 36 and the rotation shaft of the ice-fullness detecting lever 36 can position slightly to the right with respect to the center of the ice tray 34. In other words, the rotation shaft of the ice-fullness detecting lever 36 may be positioned on the lower right side with respect to the ice tray 34. Therefore, the ice-fullness detecting lever 36 effectively detects the ice in the ice-fullness position in the operating state and prevents interference with the ice tray 34 in the standby state, and can be configured to be positioned within the space between the ice tray 34 and the mounting bracket 31.

The ice-fullness detecting lever 36 may be positioned at a rear end of the ice bank 27 in a standby mode, which is an initial state before the detection of ice-fullness, and the ice-fullness detecting lever 36 is rotated so as to be capable of detecting the ice inside the ice bank 27 while moving from the rear side (the right side in FIG. 5) of the ice bank 27 across the inside of the ice bank 27 to the front side of the ice bank in a detecting mode state which is rotated so as to detect ice in the ice bank 27.

The ice-fullness detecting lever 36 is rotated so as to detect an ice-fullness state, and in a state of being positioned at the lowest position, the distance D2 between the ice tray 34 and the ice-fullness detecting lever 36 can be formed so as to be same as or somewhat larger than the width of ice generated in the ice tray 34, that is the width D1 of the opened upper surface of the cell. Therefore, it can be prevented that the ice which is dropped in the ice tray 34 in the course of ice-separation or the ice which is in contact with the ice-fullness detecting lever 36 during the rotation of the ice-fullness detecting lever 36 is caught between the ice tray 34 and the ice-fullness detecting lever 36.

Then, the ice-fullness detecting lever 36 rotates by the set angle $\alpha$ until the ice-fullness is detected on the basis of the standby state. At this time, the end portion of the ice-fullness detecting lever 36 is positioned at the lowermost position in a state where the setting angle is rotated by a set angle of approximately 65°. Specifically, the ice-fullness detecting lever 36 is configured to rotate below the ice tray 34, in the standby mode state, the upper end of the ice-fullness detecting lever 36 is disposed in a space between the ice tray 34 and the mounting bracket 31, and, in the detection mode state, the lower end of the ice-fullness detecting lever 36 can be rotated so as to position at a point for detecting the ice-fullness of the ice bank 27, and at this time, the rotation angle will be 65 degrees, approximately.

At this time, the lower end portion of the ice-fullness detecting lever 36 may be configured to be rotated from the ice tray 34 until it reaches a height of one ice, that is, D2. In other words, the storage height of the ice detected by the ice-fullness detecting lever 36 may be a height that does not interfere with the ice tray 34 due to ice that is ice-cooled when the ice tray 34 is separated for ice-separation, and can be the maximum height that can be stored in the ice bank 27 while ensuring the operation of the ice tray 34 in fact.

Hereinafter, the structure and operation of the ice-fullness detecting lever 36 will be described with reference to the drawings.

Figure 6:
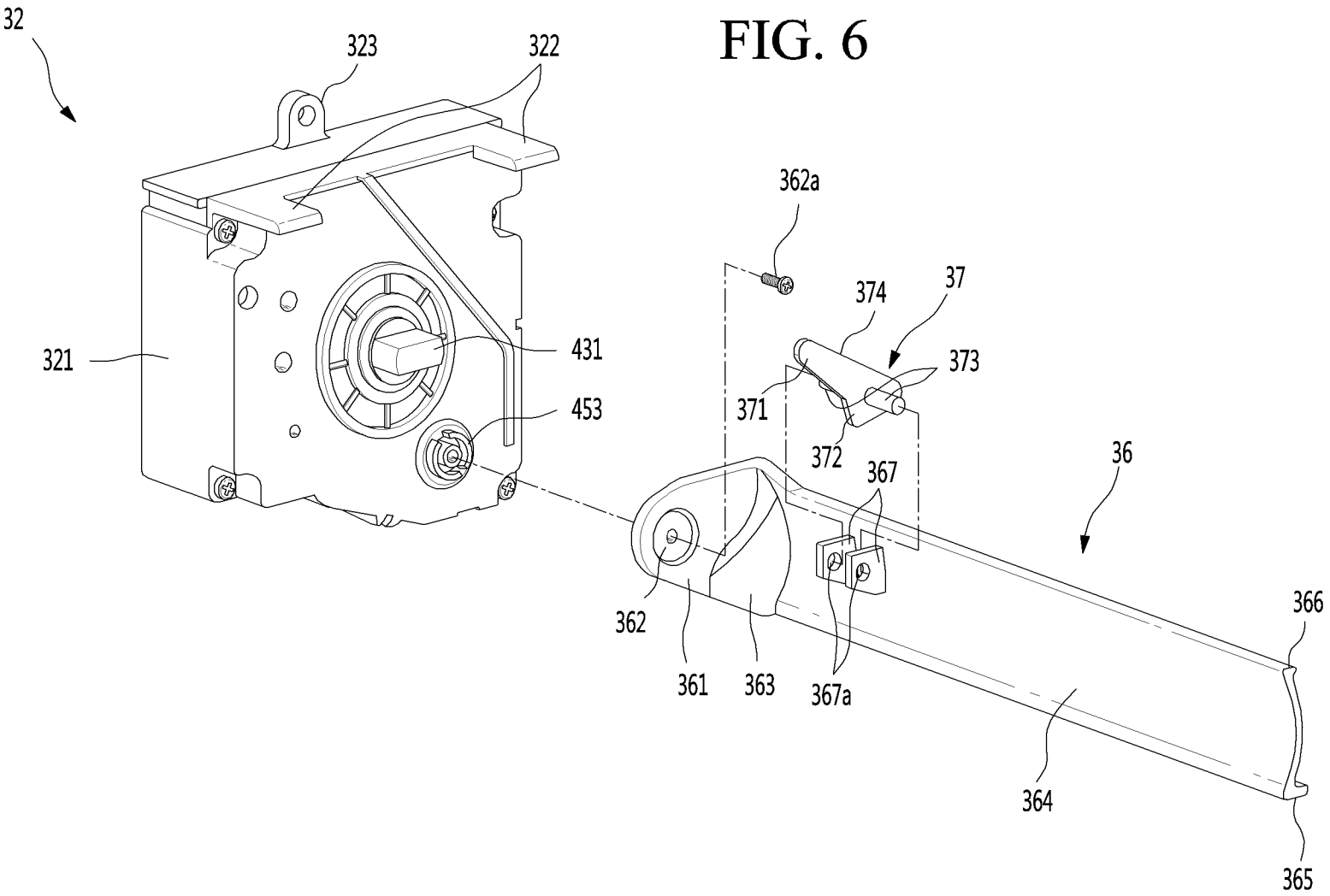
FIG. 6 is an exploded perspective view illustrating a coupling structure of an ice-fullness detecting lever of the ice-making apparatus.
Figure 7:
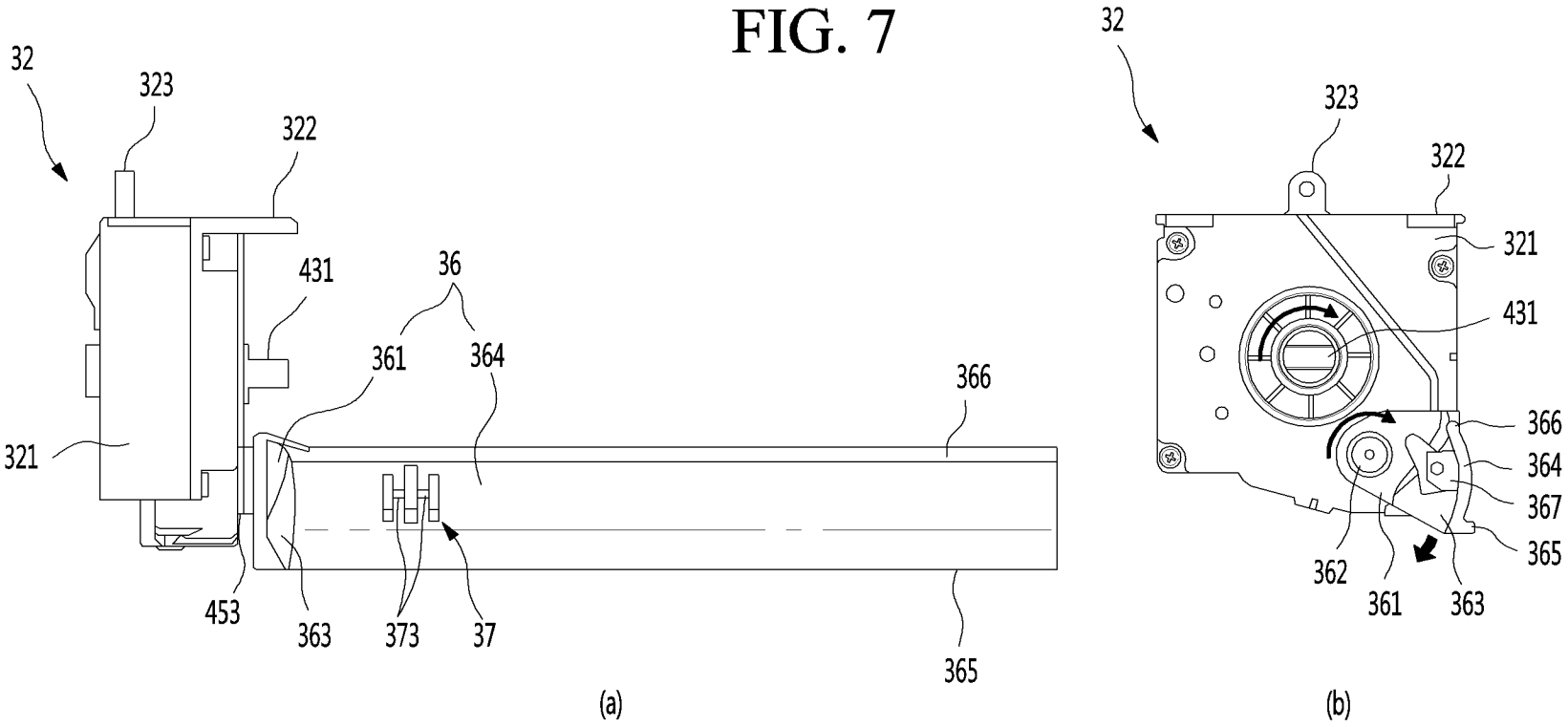
FIG. 7 is a view illustrating a state where the ice-fullness detecting lever is in a standby state.
Figure 8:
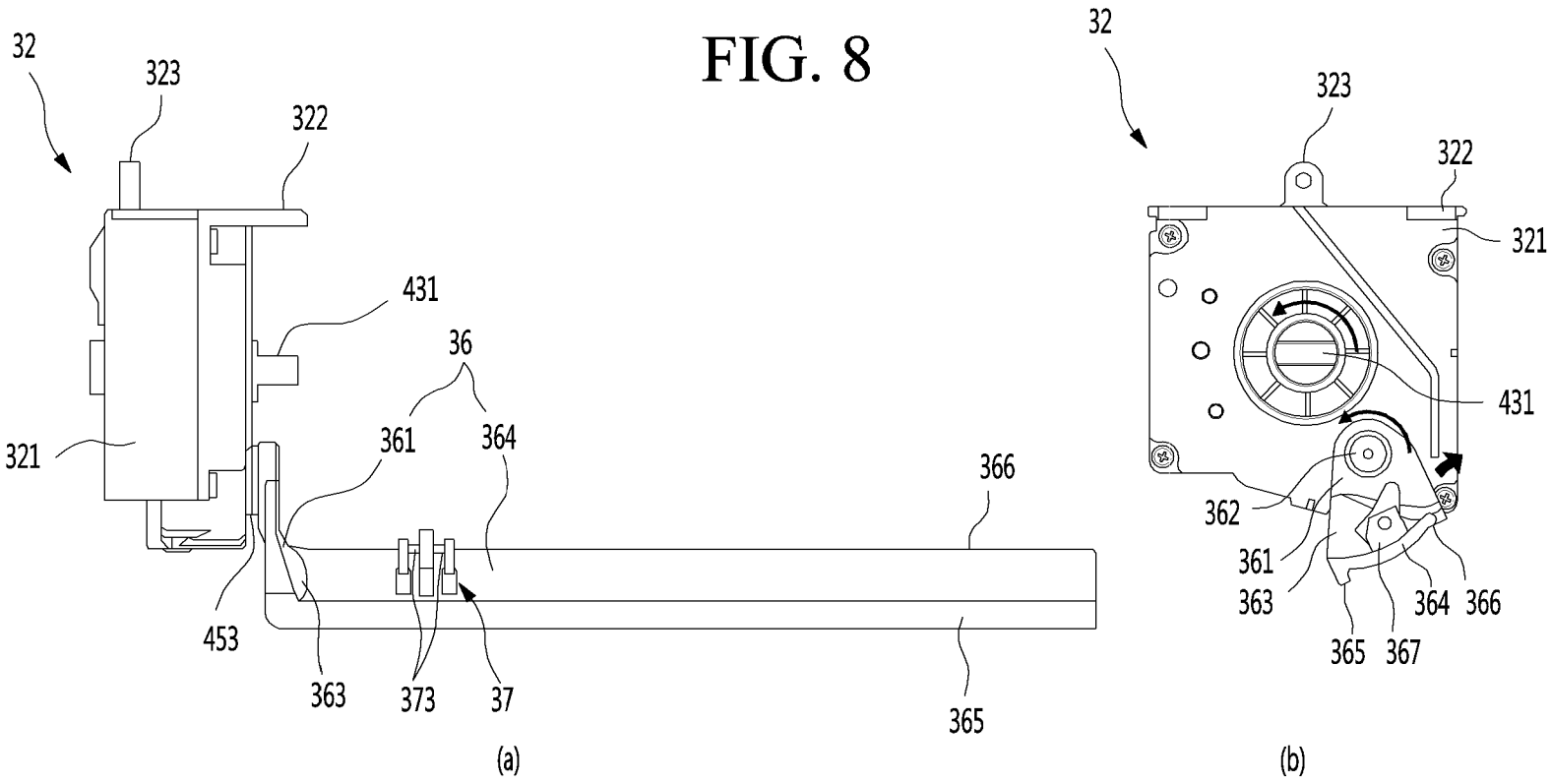
FIG. 8 is a view illustrating a state where the ice-fullness detecting lever is rotated for detecting.

FIG. 6 is an exploded perspective view illustrating the coupling structure of the ice-fullness detecting lever of the ice-making apparatus. FIG. 7 is a view illustrating the ice-fullness detecting lever in a standby state. FIG. 8 is a view illustrating a state where the ice-fullness detecting lever is rotated for detection.

As illustrated in the drawing, the ice-fullness detecting lever 36 may be mounted on one surface of the drive unit case 321 of the drive unit 32. A tray rotation shaft 431 on which the ice tray 34 is mounted may be exposed on the one surface of the drive unit case 321, and the lever rotation shaft 453 on which the ice-fullness detecting lever 36 is mounted may be exposed on the one surface of the drive unit case 321. Therefore, the ice tray 34 and the ice-fullness detecting lever are coupled to the tray rotation shaft 431 and the lever rotation shaft 453, respectively, so that the ice tray 34 and the ice-fullness detecting lever 36 can be interlocked and rotated when the drive unit 32 is operated.

A case supporting portion 322 for supporting the control box 33 may be laterally extended on the upper surface of the drive unit case 321. A case fixing portion 323 which fixes and mounts the drive unit case 321 to and on the mounting bracket 31 may be formed on the upper surface of the drive unit case 321.

Meanwhile, the ice-fullness detecting lever 36 may generally extend from the lever rotation shaft 453 and may extend along the extension direction of the ice tray 34. In other words, the ice-fullness detecting lever 36 may extend from one end to the other end of the ice tray 34 and may correspond to or slightly longer than the length of the ice tray 34.

The ice-fullness detecting lever 36 may be generally formed in a bent plate shape having a predetermined width. In other words, the ice-fullness detecting lever 36 may include a connection portion 361 and a detection unit 364 that are bent in directions intersecting each other.

The connection portion 361 forms one end of the ice-fullness detecting lever 36 and may be connected to the lever rotation shaft 453. The connection portion 361 may be disposed parallel to the drive unit case 321 and may be bent vertically or at an angle close to vertical to the detection unit 364.

A shaft coupling portion 362 for coupling with the lever rotation shaft 453 is formed at one end of the connection portion 361 and the connection portion 361 may be fixedly coupled to the lever rotation shaft 453 by the coupling portion 362*a* penetrating the shaft coupling portion 362. Therefore, when the lever rotation shaft 453 is rotated, the connection portion 361 can be rotated together.

The connection portion 361 may extend in a direction perpendicular to the ice tray 34, that is, parallel to one side surface adjacent to the drive unit case 321. The connection portion 361 is formed so that the detection unit 364 does not protrude to the outside of the ice-making apparatus 30 without interfering with the rotation of the ice tray 34, and may extend to a length which can detect the ice-fullness of a predetermined height, at the same time, that is, the extended length of the connection portion 361 may correspond to the distance D2 from the lower end of the ice tray 34 to the detection unit 364.

A reinforcing portion 363 may be formed on the inner surface of the connection portion 361. The reinforcing portion 363 extends from one side of the connection portion 361 to a point which is in contact with the end portion of the detection unit 364 and may be formed thicker than the upper portion where the shaft coupling portion 362 is positioned. In other words, the reinforcing portion may be formed so that the inner surface of the connection portion 361 is stepped, and gradually increases toward the detection unit.

In addition, the height of the reinforcing portion may gradually decrease from the front end (lower end in FIG. 6) toward the rear end (upper end in FIG. 6) Generally, the height of the portion among an area of the connection portion 361 that faces the ice bank 27 is high and the thickness thereof is thin while the height thereof decreases and the thickness thereof increases toward the opposite side thereto. Therefore, the ice-fullness detecting lever 36 is prevented from being bent or broken when an impact or a load is applied to the detection unit 364 by contact with the ice when the ice-fullness detecting lever 36 is rotated. The connection portion 361 has a structure in which the width of the connection portion 361 increases from the upper end where the shaft coupling portion 362 is formed toward the lower end.

The lower end of the connection portion 361 is in contact with one end of the detection unit 364. In other words, the ice-fullness detecting lever 36 is vertically bent at the extended end portion of the connection portion 361 to form the detection unit 364.

The detection unit 364 may be formed in a plate shape having the same width as the lower end of the connection portion 361 and may extend from one end of the connection portion 361 to the extended end of the ice tray 34, that is, the length of the detection unit 364 may correspond to at least the length of the ice tray 34, so that the detection unit 364 may be configured to detect whether or not ice is in a fullness state in an area in which the ice tray 34 is disposed.

The detection unit 364 may be formed to have a predetermined width so as not to interfere with the rotation of the ice tray 34 in the standby state. The detection unit may have a structure of shielding the ice-making apparatus 30, that is, between the ice tray 34 and the upper end of the ice bank 27 so that cool air flowing from the upper side to the lower side can introduce into the inner space of the ice tray 34. Therefore, it is possible to prevent a portion of the air moving downward from leaking to the outside through the space between the ice-making apparatus 30 and the ice bank 27.

The inner surface and the outer surface of the detection unit 364 may be formed in a rounded shape. In a case where the ice falling from the ice tray 34 is in contact with the ice-fullness detecting lever 36 due to the rounded shape of the detection unit 364, the ice is not caught at the detection unit 364 so that the ice can be moved along the detection unit 364. In addition, when the ice-fullness is detected, even when ice is in contact with the ice stored in the ice bank 27, it is possible to prevent jamming during rotation, thereby enabling effective detection of the ice-fullness and return to the standby state.

At this time, it is preferable that the curvature of the rounded shape of the detection unit 364 is formed such that the ice moved along the detection unit 364 can fall on the inner front side of the ice bank 27.

A reinforcing rib 365 may be formed at one end (lower end in FIG. 6) of the detection unit 364. The reinforcing rib 365 may be bent vertically or at an angle corresponding to the vertical at one end of the detection unit 364 and may be bent from the inner surface to the outer surface of the detection unit 364. The reinforcing rib 365 may be formed at the tip of the detection unit 364 in the direction in which the detection unit 364 is rotated to detect the ice-fullness.

The reinforcing rib 365 not only reinforces the overall strength of the detection unit 364 but also prevents the detection unit 364 from being damaged or deformed when the ice is in contact with the ice-fullness detecting lever 36. Particularly, in a structure in which the contact area with the ice is widened to alleviate impact upon contact with ice, and the one end of the detection unit 364 is fixed to a side of the connection portion 361, the reinforcing rib 365 may be configured to reinforce additional strength so that the shape of the detection unit 364 can be maintained.

An auxiliary rib 366 may be formed at the other end (upper end in FIG. 6) of the detection unit 364 opposite to the position where the reinforcing rib 365 is formed. The auxiliary rib 366 may extend from one end to the other end of the rear end of the detection unit 364 and may be formed so that the rear end of the detection unit 364 may be inclined or rounded. At this time, the height of the auxiliary rib 366 is formed to be lower than the height of the reinforcing rib 365, so that the auxiliary rib 366 is reinforced to prevent the ice from being caught while being returned to the standby state and being rotated.

Meanwhile, the freezing release member 37 may be provided on one side of the inner surface of the detection unit 364. The freezing release member may be configured to release the ice-fullness detecting lever 36 from the freezing state by rotation of the ice tray 34 when the shaft of the ice-fullness detecting lever 36 is not operated by freezing.

The freezing release member 37 may be disposed between a pair of mounting portions 367 extending from the inner surface of the detection unit 364. On both sides of the freezing release member 37, a freezing release member rotation shaft 373 passing through the opening 367*a* of the mounting portion 367 may protrude. Therefore, the freezing release member 37 has a structure rotatable between the mounting portions 367.

The freezing release member 37 may be formed in a plate shape having a width which is wider from the upper portion 371 toward the lower portion 372. The upper portion 371 having a narrow width can be in contact with the ice tray 34 on the freezing release member rotation shaft 373 and the lower portion 372 having a wide width can be positioned below the freezing release member rotation shaft 373. Therefore, the center of gravity of the freezing release member 37 can be positioned below the freezing release member rotation shaft 373, and at the same time, can be positioned in front of the freezing release member rotation shaft 373. Therefore, when the ice-fullness detecting lever 36 is in the standby state, the upper portion 371 of the freezing release member 37 can be in a state of preparing for contact with the ice tray 34 in a rotated state.

The freezing release member 37 may be extended such that the upper portion 371 can be in contact with the rim portion 344 of the ice tray 34 when the ice tray 34 is rotated. The upper portion 371 of the freezing release member 37 may be formed with an inclined or rounded contact portion 374. The contact portion 374 may be in contact with the rim portion 344 of the ice tray 34, and when the ice tray 34 is rotated, the ice tray 34 can be rotated while the rim portion 344 of the ice tray is not caught by the contact portion 374 and is not restrained, and the contact portion 374 is pressed.

The operation of the freezing release member 37 will be described in more detail below.

Figure 9:
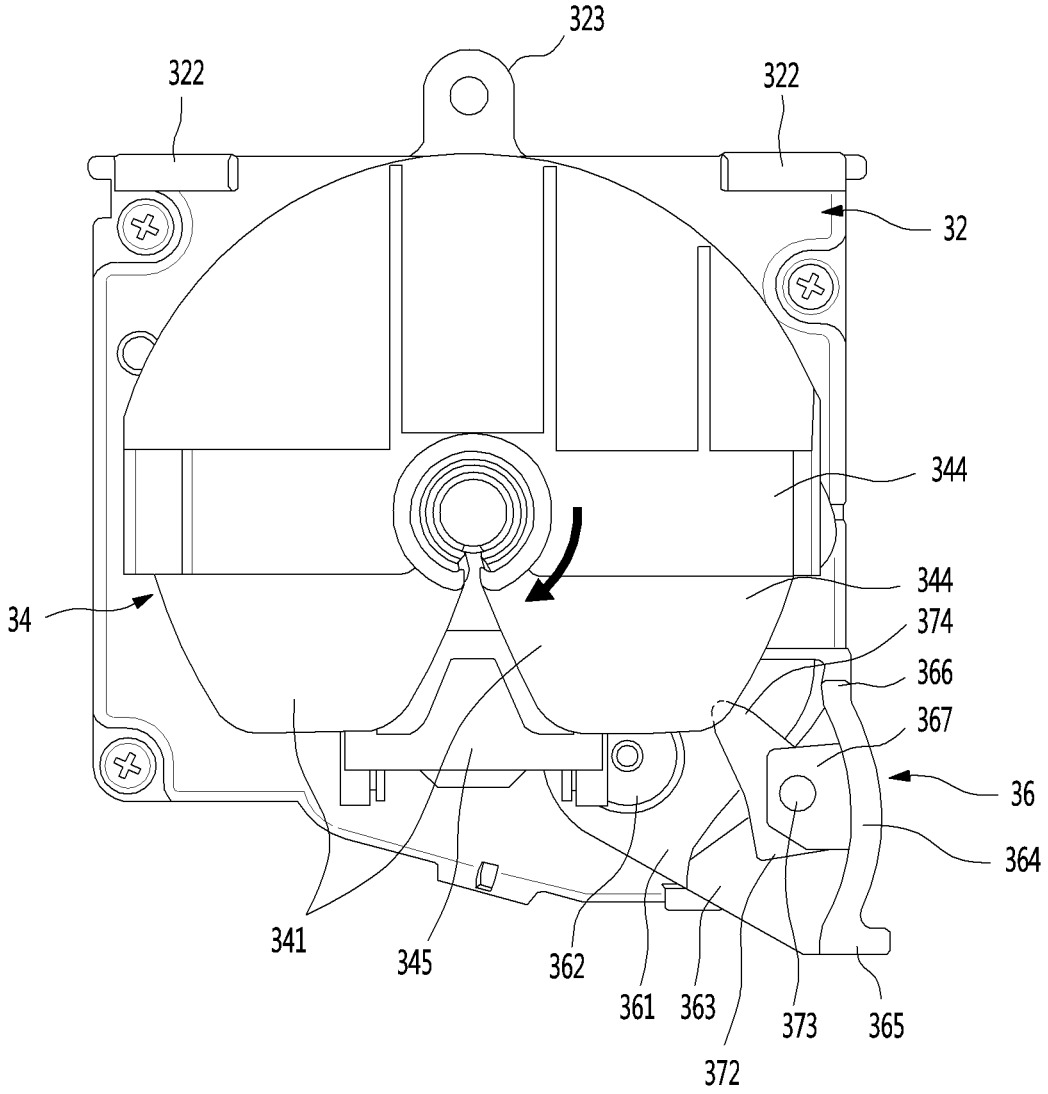
FIG. 9 is a view illustrating the state of an ice tray and the ice-fullness detecting lever when the ice-fullness detecting lever is in the standby state.
Figure 10:
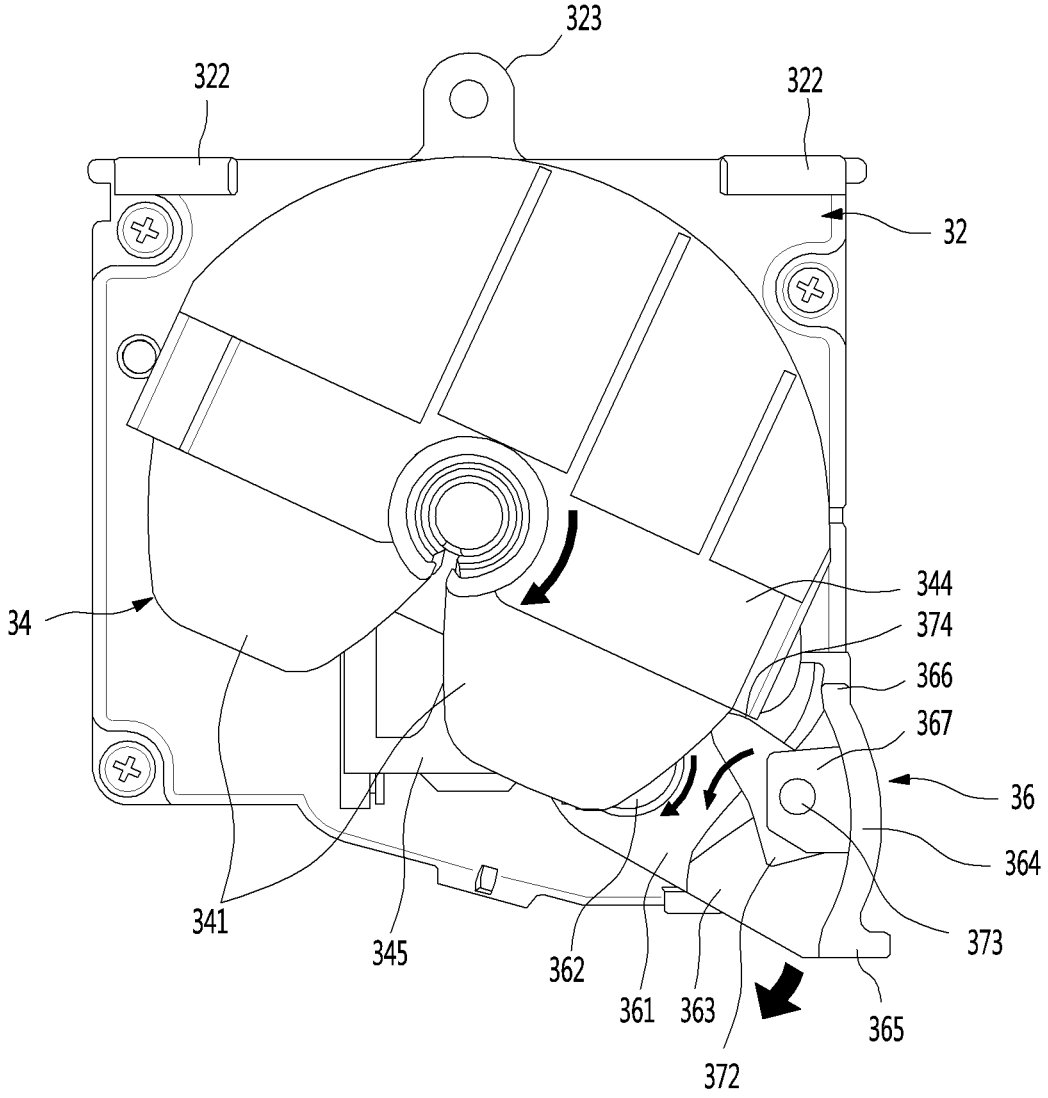
FIG. 10 is a view illustrating an operation state of a freezing release member for releasing during freezing restraint of the ice-fullness detecting lever.

FIG. 9 is a view illustrating the states of the ice tray and the ice-fullness detecting lever when the ice-fullness detecting lever is in a standby state. FIG. 10 is a view illustrating an operation state of the freezing release member for releasing when the ice-fullness detecting lever is frozen and restrained.

In a state where the ice tray 34 is not rotated for ice-separation and the ice-fullness detecting lever 36 is not operated for the ice-fullness detection, the ice tray 34 and the ice-fullness detecting lever 36 are maintained in a state of being illustrated in FIG. 9.

At this time, the freezing release member 37 may extend from the detection unit 364 toward the outer surface of the ice tray 34. The disposition position of the freezing release member 37 may be configured to protrude toward a recessed space between the cell 341 and the cell 341 on the lower surface of the ice tray 34. Accordingly, in a state as in FIG. 9, the end portion of the freezing release member 37 is only inserted into the space between the cell 341 and the cell 341 of the ice tray 34 and is not in contact with the outer surface of the ice tray 34.

The freezing release member 37 may be formed so that the center of gravity is positioned on the lower right side with respect to the freezing release member rotation shaft 373, so that the freezing release member 37 is maintained in a state of being rotated in the counterclockwise direction with respect to the freezing release member rotation shaft 373.

In this state, in a case where the ice tray 34 is rotated, the contact portion 374 of the freezing release member is positioned between the cell 341 and the cell 341 and is not in contact with the outer surface of the cell 341, but the contact portion can be in contact with the rim portion 344 of the ice tray 34 after the ice tray 34 is rotated by a predetermined angle.

Of course, in a state where the ice-fullness detecting lever 36 is not frozen, the ice-fullness detecting lever 36 is rotated in conjunction with the rotation of the ice tray 34. Accordingly, in a state of rotating for normal ice-fullness detection, the ice tray 34 and the freezing release member 37 may not be in contact with each other.

Meanwhile, the lever rotation shaft 453 of the ice-fullness detecting lever 36 or a portion adjacent to the lever rotation shaft 453 is frozen due to various conditions that the humidity in the ice-making chamber 25 is frozen and fixed or the water being supplied to the ice tray water is splashed and thus the ice-fullness detecting lever 36 may be not normally rotated.

Only the ice tray 34 can be rotated by the operation of the drive unit 32 in a state where the ice-fullness detecting lever 36 is frozen and not operated. When the ice tray 34 is rotated and reaches a predetermined angle in a state where the ice-fullness detecting lever 36 is maintained at the standby state, as illustrated in FIG. 10, the rim portion 344 of the ice tray 34 is in contact with the contact portion 374.

When the ice tray 34 is further rotated in a state where the rim portion 344 is in contact with the contact portion 374, the rim portion 344 pushes the contact portion 374 to pull the freezing release member 37. Like this, when a force is applied to the freezing release member 37, a force is applied to the ice-fullness detecting lever 36 in the rotation direction, and the freezing of the lever rotation shaft 453 of the ice-fullness detecting lever 36 is released.

The ice-fullness detecting lever 36 can be rotated in conjunction with the rotation of the ice tray 34 in a case where the restraint by freezing of the ice-fullness detecting lever 36 is released. In a state where the freezing release member 37 is rotated together with the ice tray 34, the space between the ice tray 34 and the freezing release member 37 may be further separated from each other, and any more force is not applied to the rim portion 344.

Meanwhile, when the ice-fullness detecting lever 36 is normally operated without being frozen, the section in which the ice tray 34 and the freezing release member 34 are in contact with each other contacts in an area corresponding to a section at which the rotation of the ice-fullness detecting lever is started. Therefore, immediately after the freezing of the ice-fullness detecting lever 36 is released by the freezing release member 37, the ice-fullness detecting lever 36 can be immediately rotated and, after the ice-fullness is detected, the ice-fullness detecting lever 36 can return to the standby state as in FIG. 9.

Hereinafter, the detailed structure of the drive unit for rotating the ice tray 34 and the ice-fullness detecting lever 36 will be described with reference to the drawings.

FIGS. 11 to 15 are views illustrating states of the drive unit during the operation of the ice-fullness detecting lever according to steps.

As illustrated in the drawings, the drive unit 32 includes a motor 41 for generating a driving force, a plurality of transmission gears 42 for transmitting the power of the motor 41, a tray rotation gear 43 for rotating the ice tray 34 by coupling with the transmission gear 42, a lever rotation gear 45 for rotating the ice-fullness detecting lever 36, and a connection member 44 for connects the transmission gear 42 and the lever rotation gear 45 with each other. These components for the operation of the ice tray 34 and the ice-fullness detecting lever 36 may be disposed in the drive unit case 321.

Specifically, the motor 41 is mounted inside the drive unit case 321 and can be mounted on a supporting plate 47 inside the drive unit case 321. The supporting plate 47 may be configured by a PCB for the operation of the drive unit 32.

The motor 41 is rotatable in the forward and reverse directions. The rotation of the motor 41 enables the rotation of the ice tray 34 and the ice-fullness detecting lever 36. The rotation of the motor 41 is determined by the rotation of the ice tray 34. The ice tray 34 can be rotated and stopped by detecting the rotation angle or position of the ice tray 34 for ice-separation and detecting the ice-making state and the ice-separation state. A sensor, a switch, or the like may be further provided to detect the rotation angle or position of the ice tray 34 for driving the motor 41.

The motor 41 is disposed on one side of the upper portion of the drive unit case 321 and the motor shaft 411 can be extended. The motor shaft 411 may extend to the other end of the drive unit case 321 opposite to the one side on which the motor 41 is supported and a worm gear 412 may be disposed on the motor shaft 411.

A plurality of transmission gears 42 may be continuously disposed under the worm gear 412 while being meshed with each other. The plurality of transmission gears 42 may be formed in the shape of a spur gear, and each of the transmission gears 42 may have a structure in which the gears are disposed on the upper surface and the lower surface and the gears are formed to have different diameters. The plurality of transmission gears 42 may be disposed so as to overlap with each other and meshed with each other. The first transmission gear 421, the second transmission gear 422, and the third transmission gear 423 may be continuously disposed from the upper side to the lower side of the transmission gear 42. Of course, the number of transmission gears 42 may be adjusted as needed.

In the present invention, three transmission gears 42 may be provided. The first transmission gear 421 is connected to the worm gear 412 of the motor 41, the third transmission gear 423 is connected to the tray rotation gear 43 and the connection member 44, and the second transmission gear 422 may be configured to connect the first transmission gear 421 and the second transmission gear 422. The size and gear teeth shape of each of the transmission gears 42 may be appropriately adjusted according to the size of the drive unit 32 and the disposition of the tray rotation gear 43 and the connection member 44.

The tray rotation gear 43 may be formed in a spur gear shape adapted to engage with the third transmission gear 423. In the drawing, in order to make the structure of the tray rotation gear 43 more apparent, the structure is illustrated in a sectional structure, and thus the inner part 432 and the outer part 433 thereof seems to be separated from each other, but in the overall tray rotation gear 43, the outer part 432 and the outer part 433 are integrally connected to each other at one side.

The outer part 433 of the tray rotation gear 43 includes gear teeth formed on the outer surface of the tray rotation gear 43 and rotates in engagement with the third transmission gear 423. The inner part 432 forms a central portion of the tray rotation gear 43 and may be spaced apart from the outer part 433 by a predetermined distance.

The tray rotation shaft 431 may be formed at the center of the inner part 432 and the tray rotation shaft 431 may extend through the drive unit case 321 to couple with the rotation shaft 431 of the ice tray 34. Accordingly, the ice tray 34 is rotated when the tray rotation gear 43 is rotated.

The outer periphery of the inner part 432 may include a tray guide unit 432*a*, a starting unit 432*b*, and a lever guide unit 432*c*. One side of the connection member 44 moves along the periphery of the outer surface of the inner part 432.

In other words, when the tray rotation gear 43 is rotated, one side of the connection member 44 can be configured to sequentially pass the starting unit 432*b*, the lever guide unit 432*c*, and the tray guide unit 432*a* in a section in which the ice tray 35 is rotated along the outer surface of the inner part 432.

The ice tray 34 is continuously rotated while the tray rotation gear 43 is rotated and one side of the connection member 44 may be rotated together with the ice-fullness detecting lever 36 in the course of passing the starting unit 432*b* and the lever guide unit 432*c* by the rotation of the ice tray 34.

The connection member 44 is a member which interlocks the third transmission gear 423 and the lever rotation gear 45 with each other, one side thereof is rotatably mounted on the third transmission gear 423 and the other side thereof may be extended to be connected to the lever rotation gear 45.

A connection member coupling portion 441 for coupling with the third transmission gear 423 may be formed at one end of the connection member 44. The connection member coupling portion 441 may be rotatably coupled to the third transmission gear 423 and may be mounted to have the same center of rotation as the third transmission gear 423. The connection member coupling portion 441 may be opened to insert one side of the third transmission gear 423 and the rotation shaft of the third transmission gear 423 may be inserted into the opened connection member coupling portion 441. Accordingly, the connection member coupling portion 441 can be rotatably mounted about the rotation shaft of the third transmission gear 423.

The other end of the connection member 44 may be formed with an accommodation portion 442 which is connected to the lever rotation gear 45 to operate the lever rotation gear 45. The accommodation portion 442 may be formed to be recessed inwardly from the other end of the connection member 44 and an insertion portion 451 of the lever rotation gear 45 may be inserted into the accommodation portion 442 Can be inserted. Therefore, when the connection member 44 is rotated in a state where the insertion portion 451 is inserted into the accommodation portion 442, the lever rotation gear 45 is also rotatable together. Of course, if necessary, the insertion portion 451 may be formed in the connection member 44, and the accommodating portion 442 may be formed in the lever rotation gear 45.

Meanwhile, a contact member 443 may be further provided on one side of the connection member 44. The contact member 443 can be moved along the outer surface inside the tray rotation gear 43. The contact member 443 sequentially passes the starting unit 432*b*, the lever guide unit 432*c*, and the tray guide unit 432*a*, is rotated by contact with the outer surface of the inner part 432, and can rotate the lever rotation gear 45. The contact member 443 is formed in the same shape as a roller and can be rotatably mounted on the connection member 44. Therefore, the contact member 443 can be rotated in contact with the outer surface of the inner part 432.

The lever rotation gear 45 may be disposed below the tray rotation gear 43 and may be positioned at a position corresponding to an end portion of the connection member 44. The lever rotation gear 45 may include a lever rotation shaft 453 connected to the rotation center of the ice-fullness detecting lever 36. The lever rotation shaft 453 may protrude from the center of the lever rotation gear 45 through the drive unit case 321. At this time, the lever rotation shaft 453 may protrude from one side of the drive unit case 321 that is the same as the tray rotation shaft 431 and may be positioned further downward than the tray rotation shaft 431.

An insertion portion 451 to be inserted into the accommodation portion 442 of the connection member 44 may be formed at one side of the lever rotation gear 45. The insertion portion 451 may be formed at a side away from the center of rotation of the lever rotation gear 45. Accordingly, when the connection member 44 is rotated by a predetermined angle in a state where the insertion portion 451 is inserted into the accommodation portion 442, the end portion of the connection portion is moved in the up and down direction and the insertion portion 451 is also moved together to rotate the lever rotation gear 45.

A first elastic member mounting portion 452 for mounting an elastic member 46 is formed on the other side of the lever rotation gear 45, and an elastic member 46 for providing an elastic force to the lever rotation gear 45 can be mounted on the first elastic member mounting portion 452.

The elastic member 46 may be formed in the same structure as the tension spring and may have both ends formed in a ring-like shape and fixed to the lever rotation gear 45 and the inside of the drive unit case 321, that is, one end of the elastic member 46 is coupled to the first elastic member mounting portion 452 formed on the lever rotation gear 45 and the other end of the elastic member 46 is fixed to a second elastic member mounting portion 452 formed on the inner surface of the drive unit case 321, And can be fixed to the elastic member mounting portion 324.

The elastic member 46 maintains the maximum tensile state in a state where the ice-fullness detecting lever 36 is not rotated, so that the elastic restoring force can be maximized, and, in a state where the ice-fullness detecting lever 36 is fully rotated, the elastic restoring force may be in a minimum tension state or a non-tension state. Therefore, an elastic force for rotating the ice-fullness detecting lever 36, that is, the lever rotation gear 45 can be provided.

Figure 11:
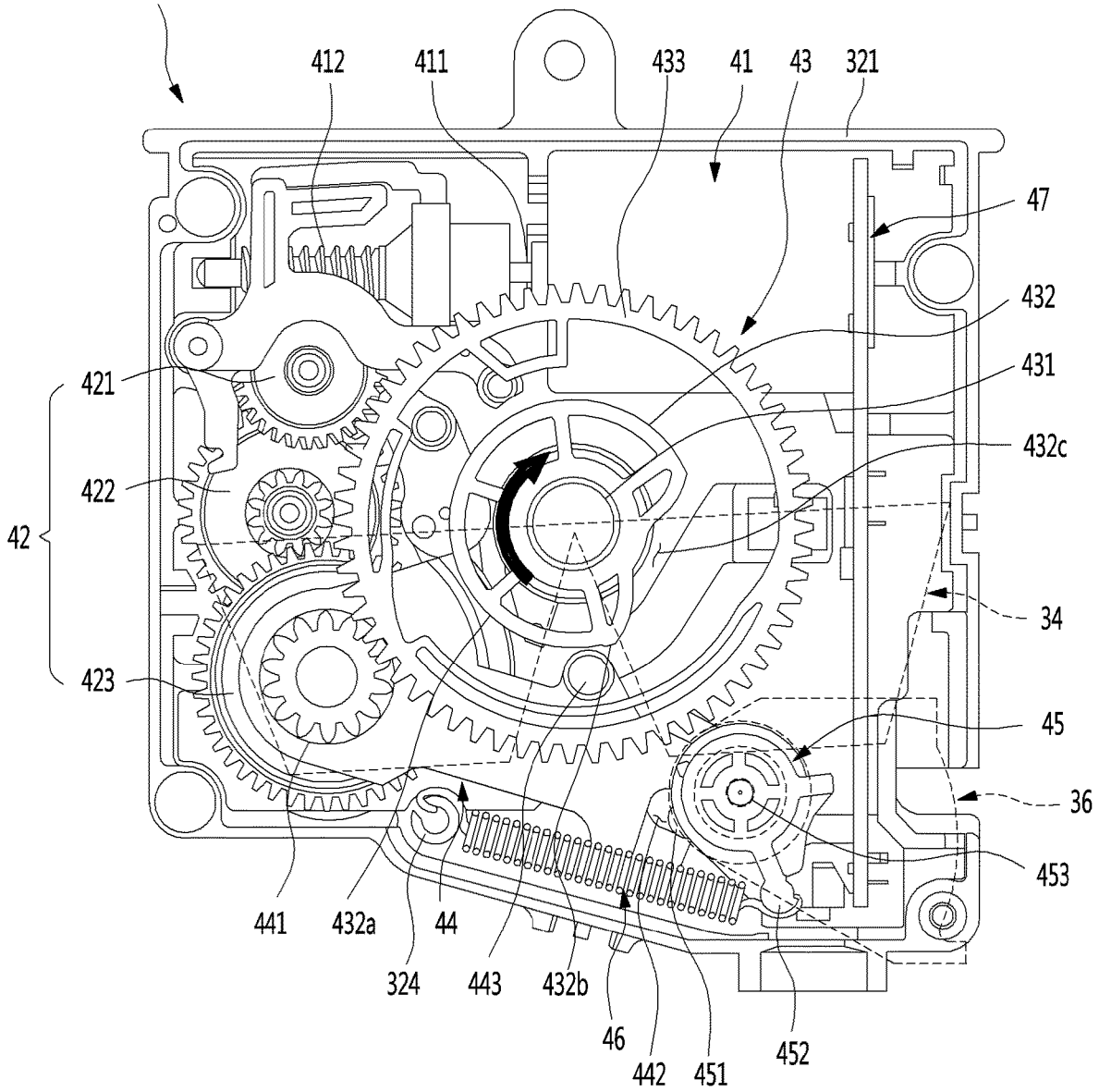
FIGS. 11 to 15 are views illustrating the states of the drive unit during the operation of the ice-fullness detecting lever according to steps.

In a case where the operation course of the ice-fullness detecting lever 36 is described in more detail, first, as in FIG. 11, when the motor 41 is driven, the transmission gear rotates, and the tray rotation gear 43 is rotated by the transmission gear 42. The ice tray 34 starts to be rotated by the rotation of the tray rotation gear 43. At this time, the contact member 443 moves along the tray guide unit 432*a* in a state where the contact member 443 is in contact with the tray guide unit 432*a* of the inner part 432 of the tray rotation gear 43.

In this state, the ice tray 34 rotates. However, in a state where the contact member 443 is in contact with the tray guide unit 432*a*, the connection member 44 maintains the initial state thereof so that the lever rotation gear 45 and the ice-fullness detecting lever 36 are also maintained in a standby state without being rotated.

Figure 12:
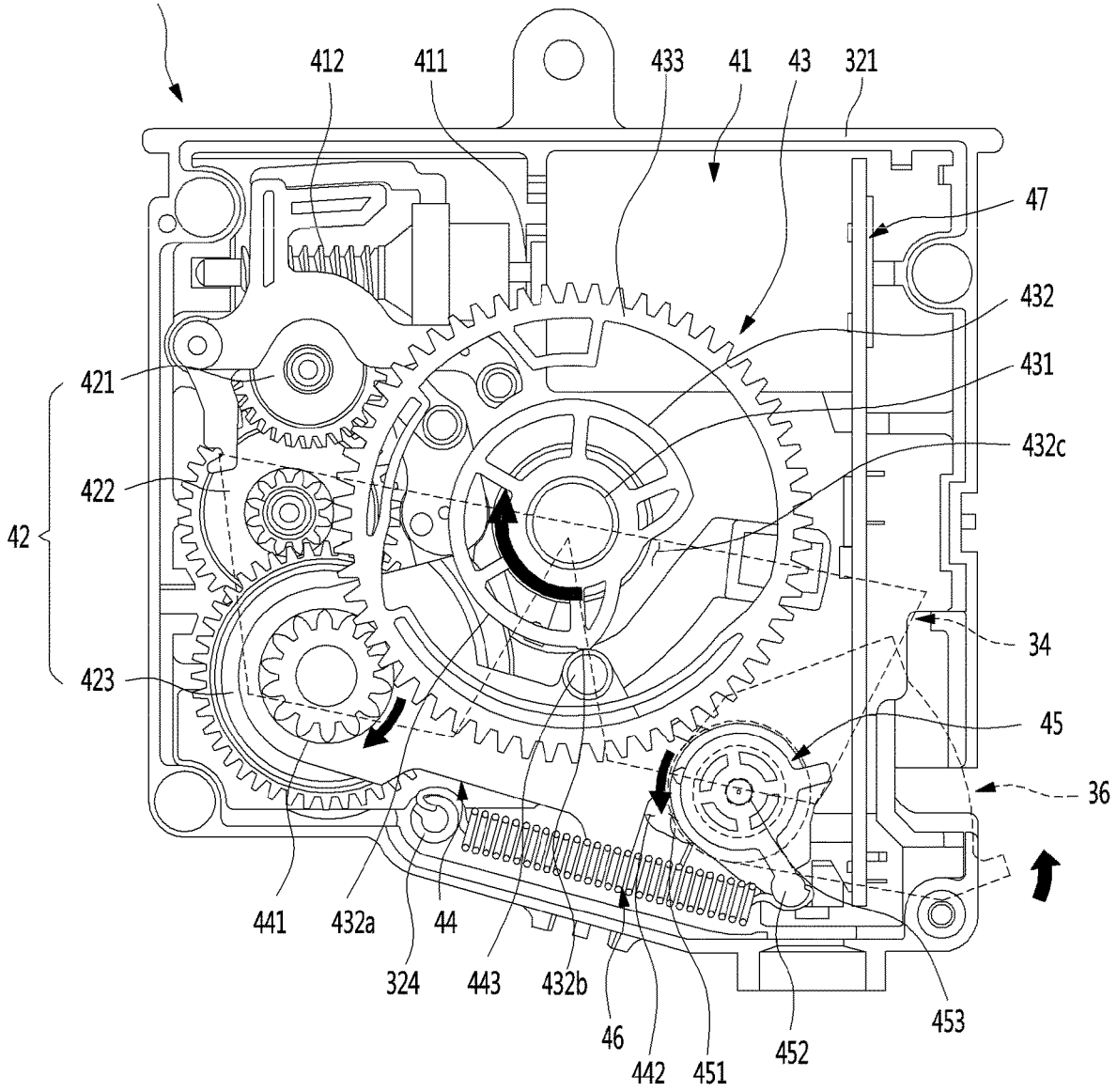

When the tray rotation gear 43 further rotates in a state of FIG. 11, the contact member 443 is in contact with the starting unit 432*b* and can be in a state as in FIG. 12. The rotation of the tray rotation gear 43 causes the contact member 443 to pass the starting unit 432*b* and the connection member 44 is instantaneously moved by the protruding shape of the starting unit 432*b* in the reverse direction.

Specifically, when the contact member 443 passes the starting unit 432*b*, the connection member 44 is instantaneously rotated in the clockwise direction, and the accommodation portion 442 pushes the insertion portion 451 so as to rotate the lever rotation gear 45 in the counterclockwise direction. The ice-fullness detecting lever 36 rotates in an instantaneous reverse rotation (counterclockwise direction) of the lever rotation gear 45. Of course, at this time, the ice tray 34 continues rotating in the clockwise direction.

When the tray rotation gear 43 is further rotated, the contact member 443 completely moves over the starting unit 432*b* and enters the lever guide unit 432*c*. The lever guide unit 432*c* is formed so as to be recessed further inward than the starting unit 432*b* and the tray guide unit 432*a* so that the contact portion 443 may be accommodated during the section in which the ice-fullness detecting lever 36 rotates to detect ice-fullness.

Figure 13:
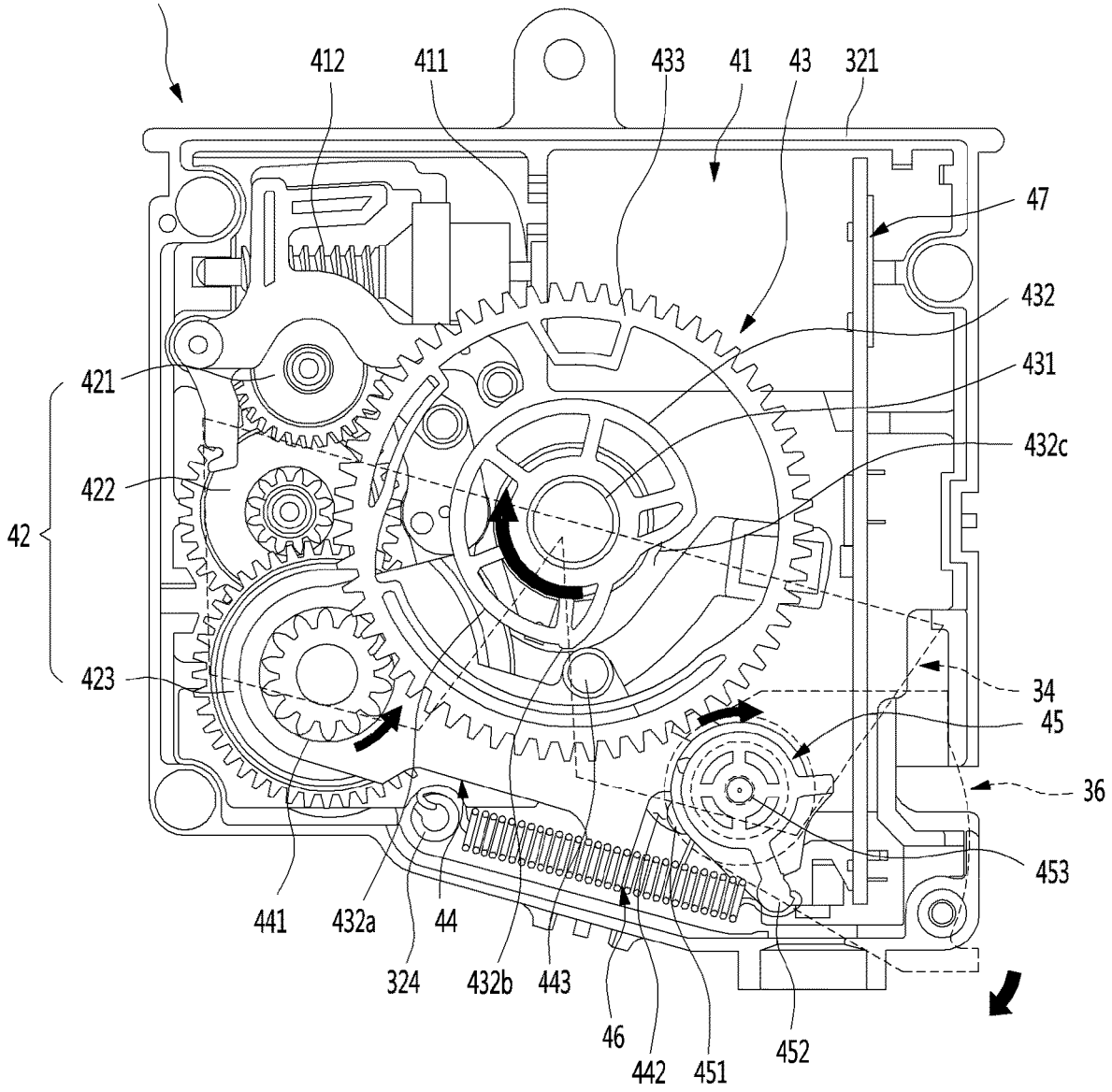

Specifically, the rotation of the tray rotation gear 43 causes the contact member 443 to enter the lever guide unit 432*c* through the starting unit 432*b* as illustrated in FIG. 13. When the contact member 443 enters the lever guide unit 432*c*, the connection member 44 starts to rotate in the forward direction (counterclockwise direction).

In other words, the connection member 44 is instantaneously rotated in the reverse direction and then is rotated in the forward direction in the course of the contact member 443 moving into the lever guide portion 432*c* through the starting unit 432*b*. Accordingly, the ice-fullness detecting lever 36 also performs a starting movement by instantaneously rotating forward and backward so that the ice-fullness detecting lever 36, the lever rotation gear 45, or the connection member 44 can rotate more smoothly to apply an instantaneous impact. In this way, it is possible to work such as releasing the freezing state of each configuration or re-arranging the gear couplings.

Figure 14:
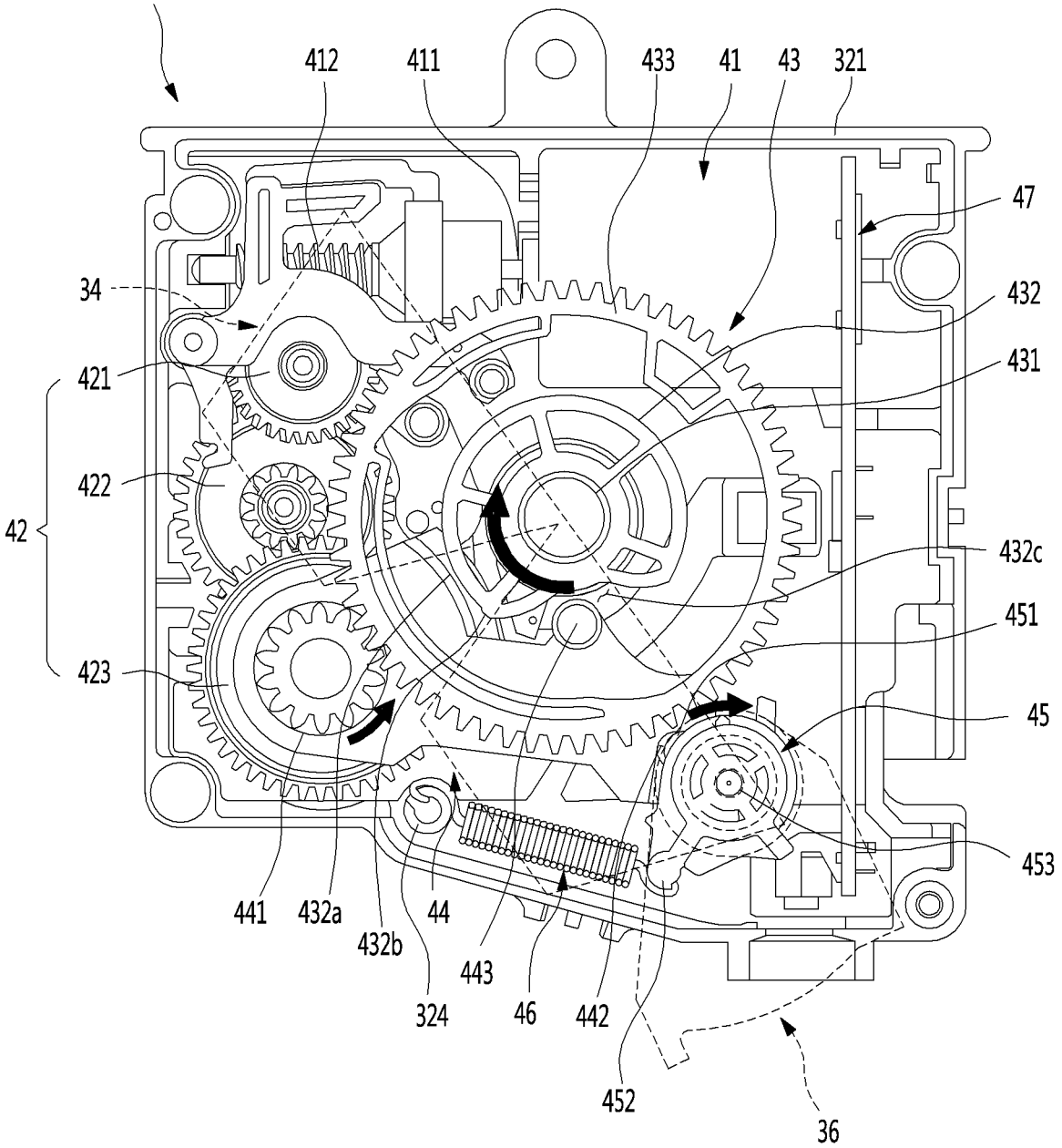

As illustrated in FIGS. 13 and 14, when the tray rotation gear 43 is continuously rotated in a state where the contact member 443 is positioned inside the lever guide unit 432*c*, the connection member 44 is rotated in the counterclockwise direction by the elastic restoring force and the accommodation portion 442 lifts the insertion portion 451 to rotate the lever rotation gear 45 in the clockwise direction. In addition, the ice-fullness detecting lever 36 is also rotated in the clockwise direction by the rotation of the lever rotation gear 45.

The ice-fullness detecting lever 36 is rotated in the clockwise direction to the point where the ice-fullness detecting lever can detect ice-fullness as illustrated in FIG.

14. At this time, the contact member 443 is positioned inside the space of the lever guide unit 432*c* and may not be in contact with the inner part 432. Also, the elastic member 46 may be in a state where the elastic member 46 is contracted not to provide an elastic restoring force.

Meanwhile, As illustrated in FIG. 14, when the ice-fullness detecting lever 36 is rotated, if the ice in the ice bank 27 is stored at a position above the ice-fullness position, the ice can interfere with by the ice-fullness detecting lever 36, The ice-fullness detecting lever 36 cannot be rotated and can be maintained in a state of interference. In this state, the state of the ice-fullness detecting lever 36 is detected by a sensor or a switch provided in the ice-making apparatus 30 to stop the ice-separation and water supply operations of the ice-making apparatus 30 and thus ice no longer supplied in the ice bank 27.

Figure 15:
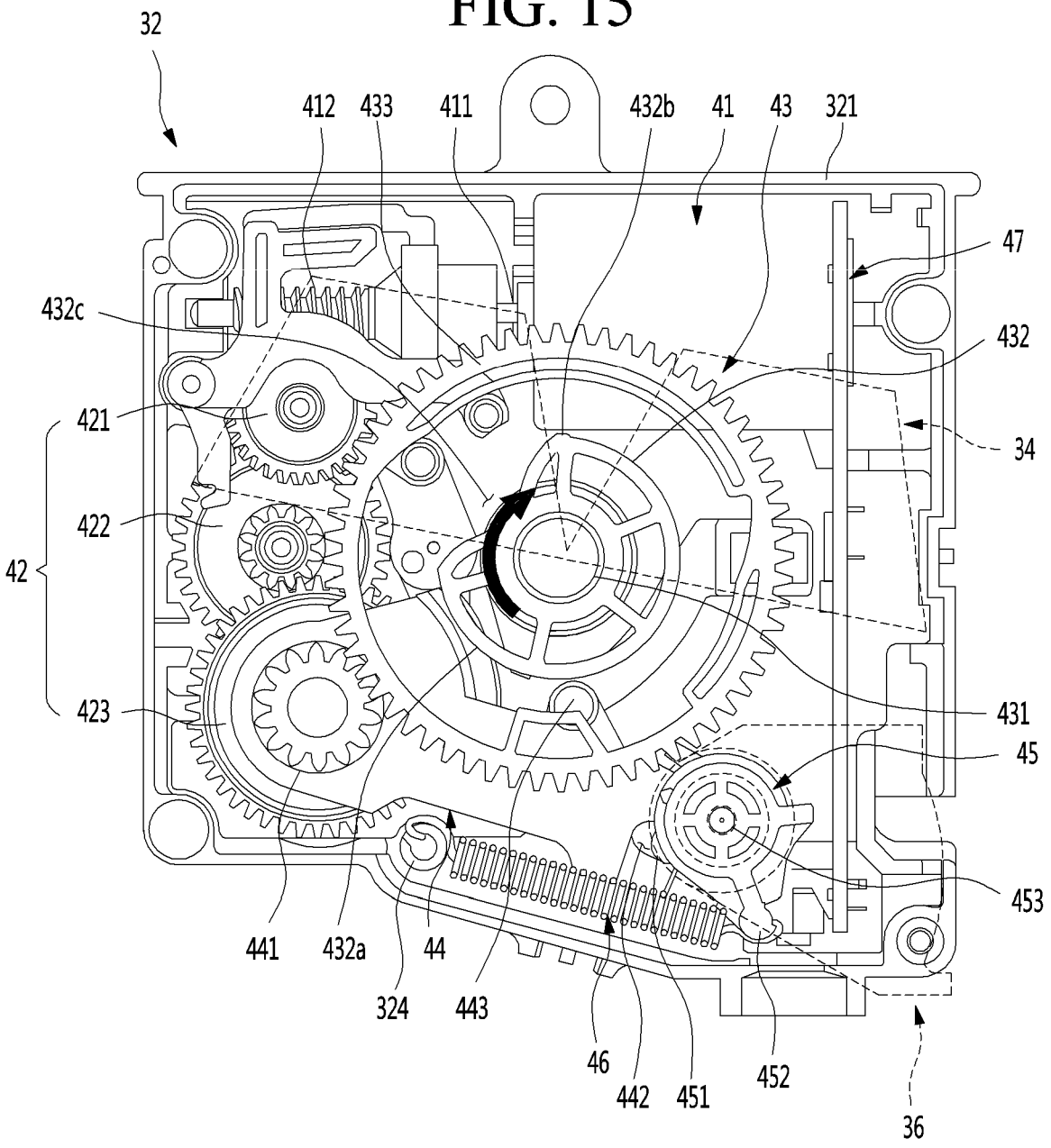

Meanwhile, as illustrated in FIG. 14, when the ice-fullness detecting lever 36 is normally reached to the ice-fullness position, the ice storage state in the ice bank 27 may be determined to be not in the ice-fullness state. Then, the ice tray 34 is further rotated as illustrated in FIG. 15. In the course of being rotated as illustrated in FIG. 15, the ice of the ice tray 34 is separated downward and falls into the ice bank 27.

At this time, the ice-fullness detecting lever 36 is rotated in the counterclockwise direction from the ice-fullness detecting position to the standby state as illustrated in FIG. 11. Specifically, in a state as in FIG. 14, when the tray rotation gear 43 further is rotated, the contact member 443 escapes from the inside of the lever guide unit 432*c* recessed inward and moves to a side of the tray guide unit 432*a* again.

The inside of the lever guide unit 432*c* is recessed and both ends of the lever guide unit 432*c* are formed to be inclined or rounded so that when the tray rotation gear 43 is continuously rotated, the contact member 443 can escape from the lever guide unit 432*c* and be moved to the tray guide unit 432*a* while being in contact with the end portion of the lever guide unit 432*c*.

The connection member 44 is rotated in the clockwise direction again as the contact member 443 is moved to the tray guide unit 432*a* and the accommodation portion 442 of the connection member 44 can push the insertion portion 451 of the lever rotation gear 45 downward to rotate the lever rotation gear 45 in the counterclockwise direction. Therefore, the ice-fullness detecting lever 36 is rotated in the counterclockwise direction to reach the standby state.

At this time, the elastic member 46 may be tensioned while the connection member 44 is rotated in the course of escaping the contact member 443 from the lever guide unit 432*c*, so that the contact state of the contact member 443 and the inner part 432 can be maintained while the elastic member applies the elastic restoring force to the connection member 44.

Meanwhile, in the course of the ice tray 34 is rotated and the ice is separated, the ice-fullness detecting lever 36 may be rotating, and at this time, some of the ice separated from the ice tray 34 may be in contact with the detection unit 364 of the ice-fullness detecting lever 36 and may be guided toward the inside of the ice bank 27 along the inner surface of the ice-fullness detecting lever 36.

Hereinafter, the operation of the ice-making apparatus 30 of the refrigerator 1 having the above structure will be described with reference to the drawings.

Figure 16:
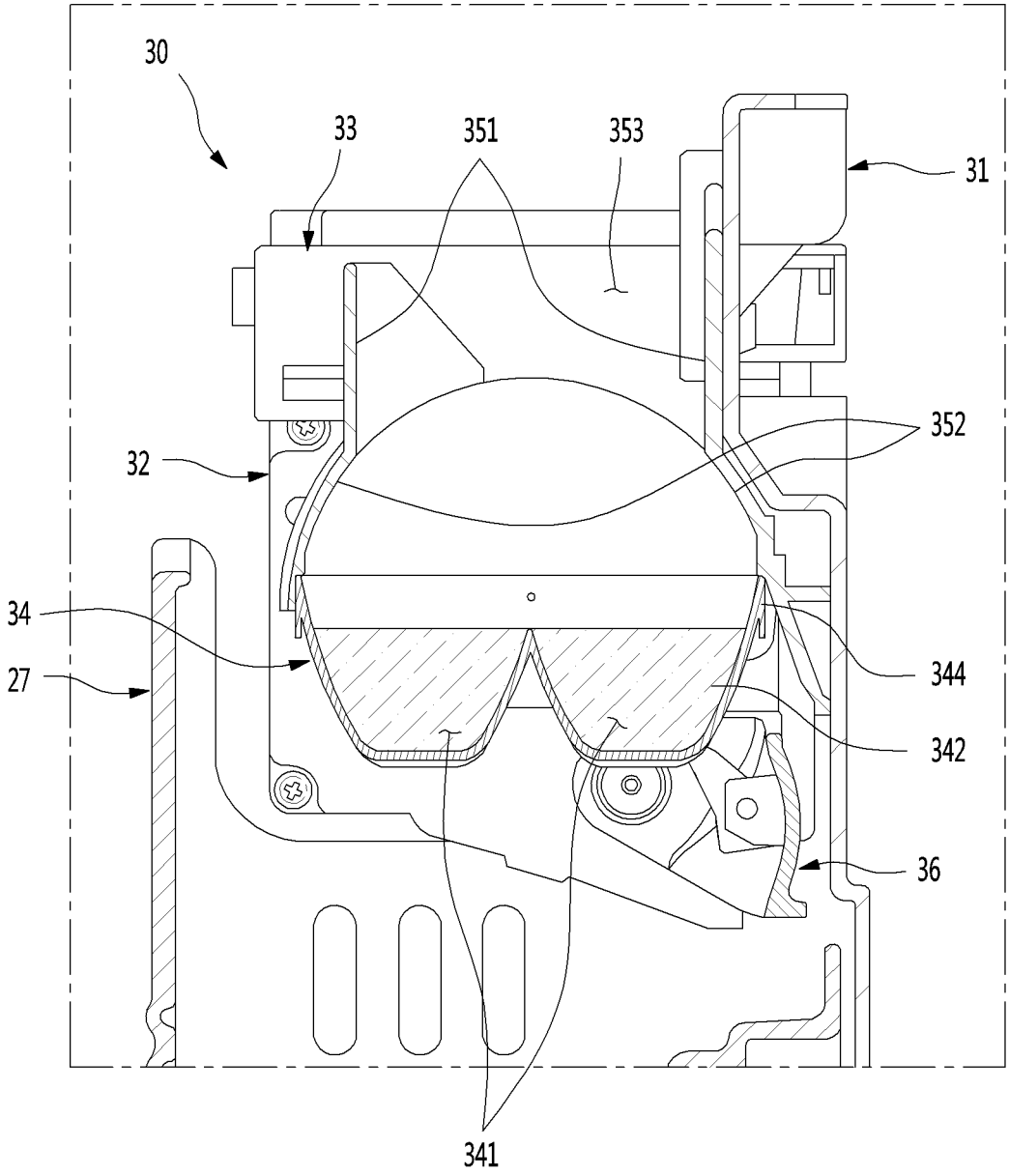
FIG. 16 is a view illustrating a state where the ice is made in the ice-making apparatus.

FIG. 16 is a view illustrating a state where the ice is made in the ice-making apparatus.

As illustrated in the drawing, water can be supplied to the ice tray 34 by the water supply device 26 for ice-making. Cooling air supplied into the ice-making chamber 25 can be supplied to the ice tray 34 through the tray cover 35.

At this time, the ice tray 34 maintains the horizontal state as illustrated in FIG. 16, and, at this time, the rim portion 344 of the ice tray 34 may be in contact with the tray cover 35.

In addition, when the ice-fullness detecting lever 36 becomes a standby state, the detection unit 364 is separated from the rotation path of the ice tray 34 and the ice tray 34 starts to rotate, the detection unit 364 does not interfere with the ice tray 34.

In a state where the ice-fullness detecting lever 36 is in the standby state, the ice-fullness detecting lever 36 is positioned inside the space formed by the lever disposition portion 354 which is obliquely formed on the lower end of the tray cover 35. The detection unit 364 of the ice-fullness detecting lever 36 is positioned between the lower end of the lever disposition portion 354 and the upper end of the rear wall of the ice bank 27. Accordingly, the cool air passing through the ice tray 34 can be directed to the ice bank 27 along the inner surface of the detection unit 364, can be shielded by the detection unit 364, and can be prevented from being lost to the outside of the ice bank 27.

Meanwhile, in a case where it is determined by the temperature sensor 345 provided in the ice-making apparatus 30 that ice-making is completed in the ice tray 34, the ice tray 34 may be rotated for ice-separation.

Figure 17:
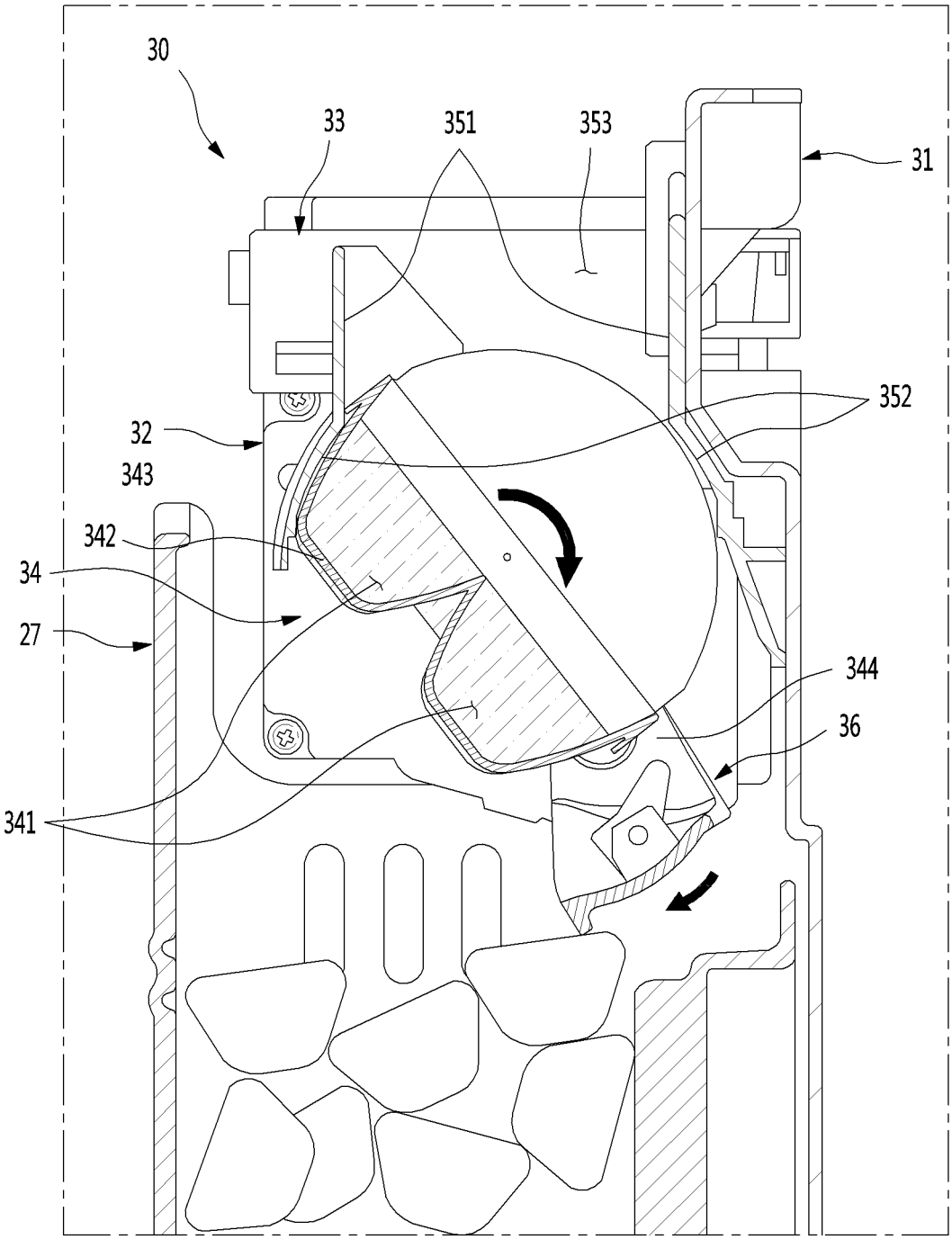
FIG. 17 is a view illustrating a state where ice-fullness is detected in the ice-making apparatus.

FIG. 17 is a view illustrating a state where ice-fullness is detected in the ice-making apparatus.

As illustrated in the drawing, the ice-fullness detecting lever 36 may be rotated together with the ice tray 34, in the course of the ice tray 34 is rotated for ice-separation. The operation of the ice-fullness detecting lever 36 is specifically illustrated in FIGS. 11 to 15, and in a case where the ice tray 34 is rotated by a predetermined angle as illustrated in FIG. 17, the ice-fullness detecting lever 36 is also rotated in conjunction with the ice tray 34.

It is possible to confirm whether or not the ice stored in the ice bank 27 is full by rotating the ice-fullness detecting lever 36, and in a case where the ice stored in the ice bank 27 is not in a state of ice-fullness, the ice-fullness detecting lever 36 is completely rotated in the clockwise direction, reaches the ice-fullness detecting position, and then is rotated in the counterclockwise direction again to return to the original position. At this time, when ice-fullness is detected by the ice-fullness detecting lever 36, the ice tray 34 stops rotating for ice-separation and rotates in the rearward direction to return to the original ice-making position.

Meanwhile, the ice tray 34 and the ice-fullness detecting lever 36 are rotated in the same direction so that when the ice falls from the ice tray 34 and ice is accumulated in the ice bank 27, since the ice-fullness detecting lever 36 passes the area where ice is actually accumulated while being rotated, erroneous detection can be prevented.

In addition, since the ice-fullness detecting lever 36 is formed in a plate-like shape, it is possible to reliably detect ice in a case where the ice in the ice bank 27 is at an ice-fullness height, and stable detection of ice-fullness becomes possible without being destroyed or damaged even in a case of being repeatedly in contact with ice.

In a case where the ice bank 27 is not in the ice-fullness state, when the ice tray 34 is continuously rotated while the ice tray 34 is rotated and the ice tray 34 is rotated at a predetermined angle or more, the ice of the ice tray 34 can be separated to the ice bank 27.

Figure 18:
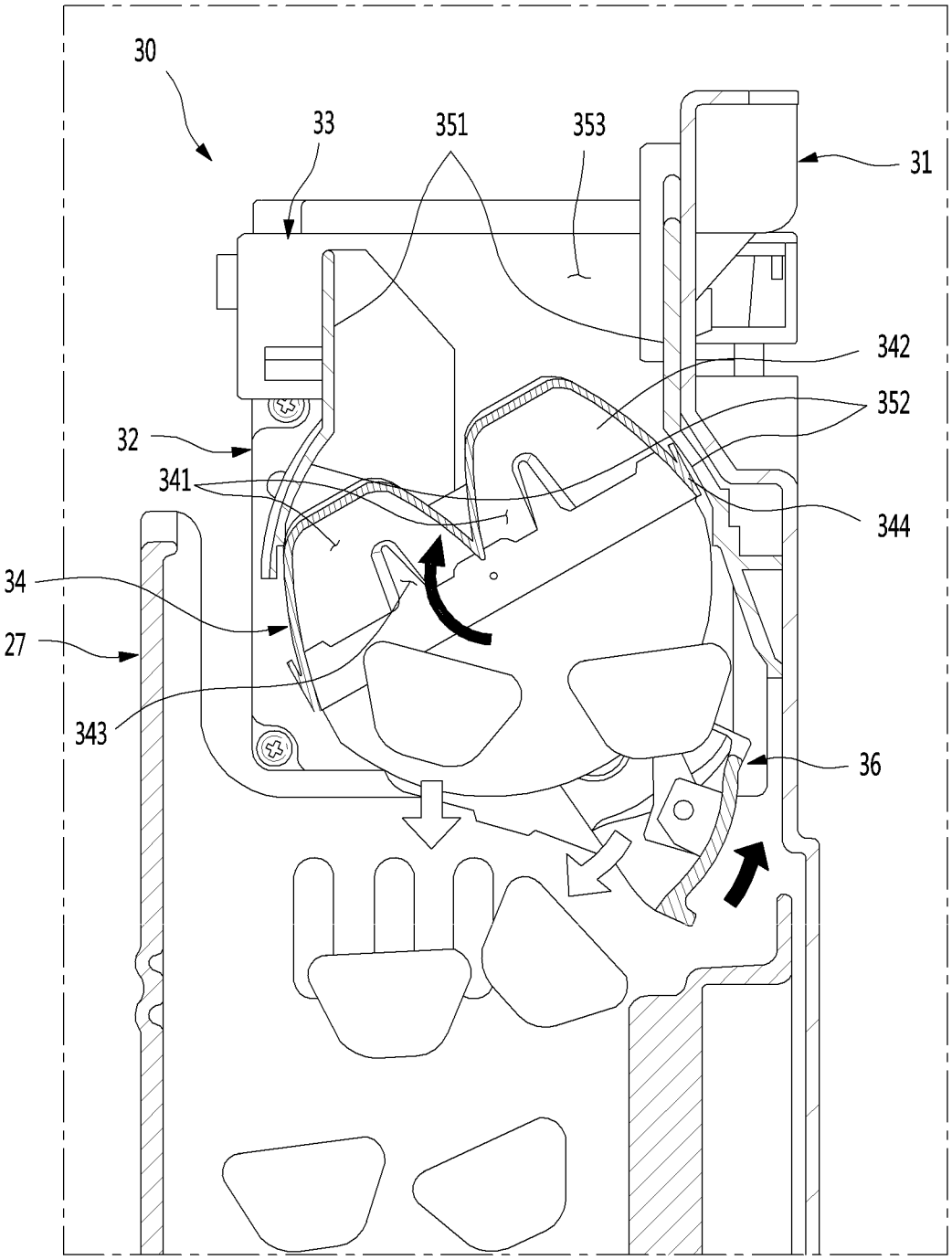
FIG. 18 is a view illustrating a state where ice is separated from the ice-making apparatus.

FIG. 18 is a view illustrating a state where ice is separated from the ice-making apparatus.

As illustrated in the drawing, the ice tray 34 may be rotated by a predetermined angle in order to separate made-ice, and in a state where the ice tray 34 is rotated by a predetermined angle or more, ice falls down from the ice tray 34.

In the course of falling ice downward, some of the ice may hit the ice-fullness detecting lever 36 and is guided along the inner curved surface of the detection unit 364 so as to be accumulated on one side of the ice bank 27.

In other words, as illustrated in FIG. 18, the ice tray 34 may be separated from the ice tray 34 before the ice tray 34 is completely rotated upside down, and at this time, the ice-fullness detecting lever 36 may be in a state of being rotated in order to return to the standby state.

In such a state, falling ice is moved along the inner surface of the detection unit 364 without being caught by the ice-fullness detecting lever 36 even when hitting the ice-fullness detecting lever 36. In particular, the ice-fullness detecting lever 36 can uniformly guide the falling ice while rotating, so that the ice can be evenly distributed in the ice bank 27.

Particularly, even in a state where the ice-fullness detecting lever 36 is completely moved to the standby state, the inner surface of the detection unit 364 is directed toward the inside of the ice bank 27, and in a case where ice falling from the ice tray 34 is directed toward a side of the detection unit 364, the ice can be guided to the inside of the ice bank 27.

Like this, the ice-fullness detecting lever 36 is rotated across the inside of the ice bank 27 and ice-fullness can be detected in an even area of the ice bank 27, and ice separated from the ice tray 34 can be distributed evenly to the ice bank 27.

When the ice tray 34 is completely turned upside down, all the ice in the ice tray 34 falls and is stored inside the ice bank 27 and the ice-fullness detecting lever 36 returns to the initial position and thus becomes a standby mode state.

In this state, the ice tray 34 may be stopped until the freezing is completely completed, and when the time set so that the ice-separation is fully completed has elapsed, the tray rotation gear 43 is further rotated in the counterclockwise direction and the ice tray 34 is returned to a water suppliable state as illustrated in FIG. 11 again for ice-making.

Of course, if necessary, in a state as in FIG. 18, the ice tray 34 may reversely rotate the tray rotation gear 43 in the clockwise direction by reversely rotating the motor 41 and the ice tray 34 may be brought into a state as illustrated in FIG. 11 by being operated in the reverse order of the course as described above.

Various other embodiments of the present invention will be possible in addition to the embodiment described above.

Another embodiment of the present invention is that the ice-fullness detecting lever and the ice tray are rotated in directions opposite to each other. The other embodiment of the present invention is different from the embodiment described above only in the disposition position of the ice-fullness detecting lever, and all the other configurations are the same, so that the same names and reference numerals are used for the same components, and The detailed description and the illustration thereof may be omitted.

Figure 19:
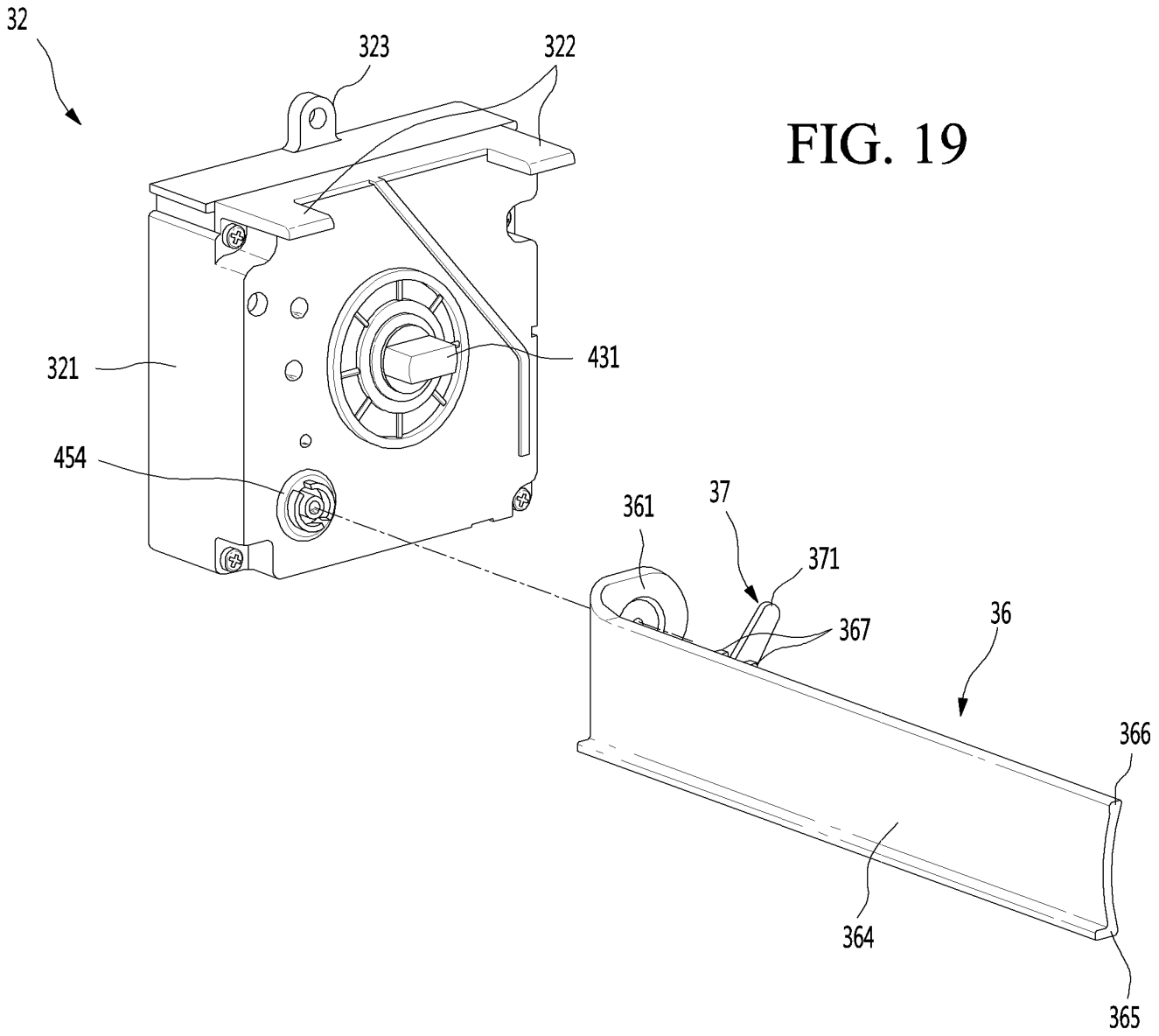
FIG. 19 is an exploded perspective view illustrating a coupling structure of the ice-fullness detecting lever of an ice-making apparatus according to another embodiment of the present invention.
Figure 20:
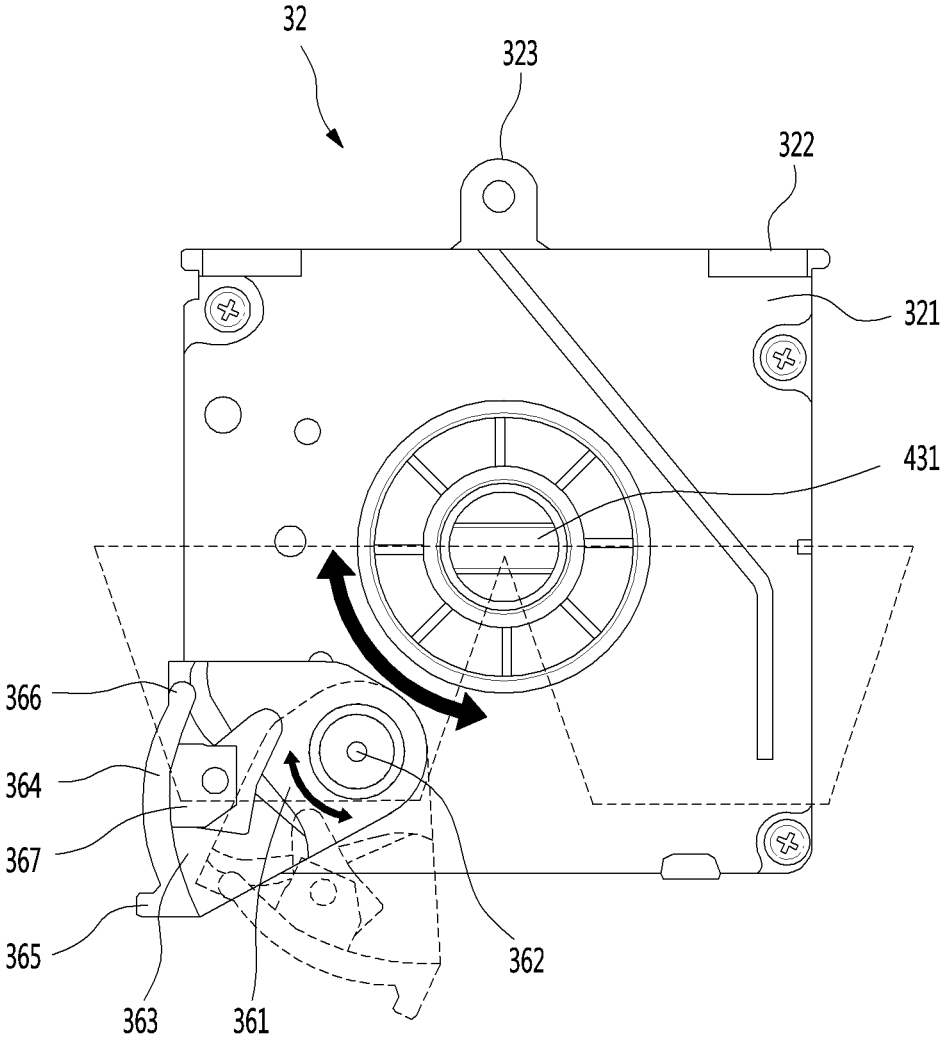
FIG. 20 is a side view illustrating the operation of the ice tray and the ice-fullness detecting lever.

FIG. 19 is an exploded perspective view illustrating a coupling structure of the ice-fullness detecting lever of an ice-making apparatus according to another embodiment of the present invention. FIG. 20 is a side view illustrating the operation of the ice tray and the ice-fullness detecting lever.

The ice-making apparatus according to another embodiment of the present invention may be disposed inside the ice-making chamber 25 as in the embodiment described above and may be disposed above the ice bank 27.

The ice-making apparatus 30 may include the drive unit 32, the control box 33, the ice tray 34, and the ice-fullness detecting lever 36.

The drive unit 32 includes a motor 41 and a plurality of gears 42, 43, 44 and 45 in the drive unit case 321 so that the configurations for driving the ice tray 34 and the ice may be provided, and a tray rotation shaft 431 coupled with the ice tray 34 may be disposed on an inner surface of the drive unit case 321, that is, a surface on which the ice tray 34 is disposed. A lever rotation shaft 454 coupled with the ice-fullness detecting lever 36 may be disposed on the same surface as the tray rotation shaft 431.

The lever rotation shaft 454 is positioned below the tray rotation shaft 431 and is positioned on the left side as viewed in FIG. 19. In other words, the ice-fullness detecting lever 36 may be disposed to be rotatable on the lower left side of the ice tray 34.

At this time, the ice-fullness detecting lever 36 may rotate in the counterclockwise direction to detect ice stored in the ice bank 27. The ice tray 34 may be rotated in the same counterclockwise direction as the ice-fullness detecting lever 36.

The ice tray 34 and the ice-fullness detecting lever are rotated in the same direction so that the ice falling from the ice tray 34 can be prevented from being caught in the ice-fullness detecting lever 36. The ice-fullness detecting lever 36 is moved across the ice bank 27 to detect ice-fullness, during such as an operation, the ice falling from the ice tray 34 can be guided downward, and then the ice can be guided to the inside of the ice bank 27 evenly.

Of course, the structure and the shape of the ice-fullness detecting lever 36 are the same as those of the embodiment described above, and only the mounting position will be changed from the right side to the left side (when being viewed in FIG. 19) Only the rotational direction of the ice tray 34 and the ice-fullness detecting lever 36 will be changed. Accordingly, the gear dispositions inside the drive unit 32 will be appropriately changed and disposed.

Various other embodiments of the present invention will be possible in addition to the embodiment described above.

In another embodiment of the present invention, the ice-making apparatus is provided in the freezing chamber. In another embodiment of the present invention, since only the door on which the ice-making apparatus is mounted and disposition thereof is different from the embodiment described above and the configurations of the ice-making apparatus itself are the same as those of the embodiment described above, the same names and reference numerals are used for the same configurations, and the description and the illustration thereof may be omitted.

Figure 21:
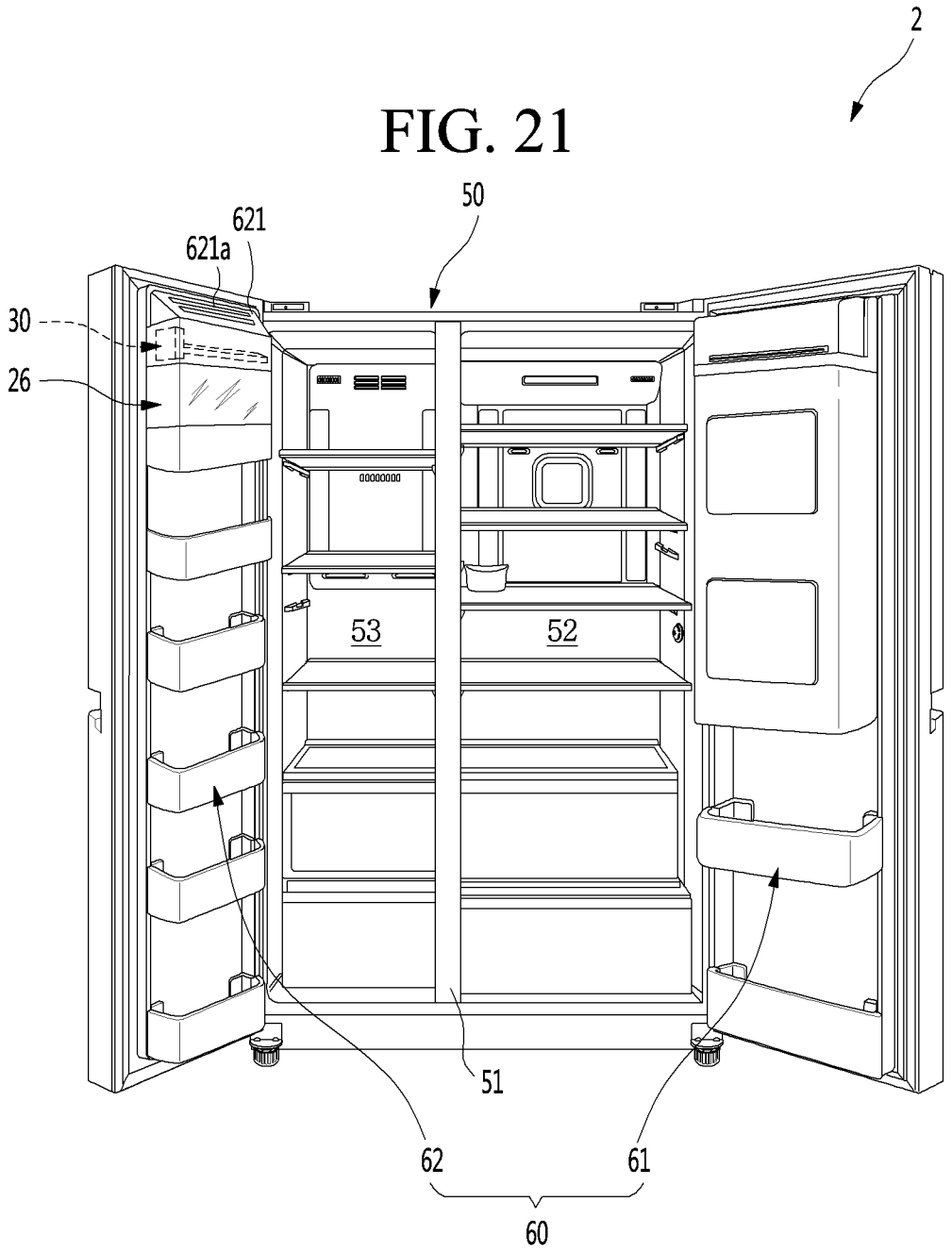
FIG. 21 is a view illustrating a state where a door of a refrigerator in which an ice-making apparatus is mounted according to another embodiment of the present invention is opened.

FIG. 21 is a view illustrating a state where a door of a refrigerator on which an ice-making apparatus is mounted according to another embodiment of the present invention is opened.

As illustrated in the drawing, the refrigerator 2 according to another embodiment of the present invention may include a cabinet 50 in which a storage space is formed, and a door 60 for opening and closing the storage space.

The interior of the cabinet 50 is divided by a barrier 51 dividing the storage space in the left and right direction to form a refrigerating chamber 52 and a freezing chamber 53, respectively. The door 61 may include a refrigerating chamber door 61 and a freezing chamber door 62 which independently open and close the refrigerating chamber 52 and the freezing chamber 53, respectively. The refrigerating chamber door 61 and the freezing chamber door 62 may be rotatably mounted on the cabinet 50.

An ice-making apparatus 30 may be provided on the rear surface of the freezing chamber door 62. The ice-making apparatus 30 and the ice bank 27 have the same structure as that of the embodiment described above, but there is a difference that the ice-making apparatus 30 and the ice bank 27 are directly mounted on the rear surface of the freezing chamber door 62.

The ice-making apparatus 30 and the ice bank 27 can be accommodated in the ice-making case 621 such that the cool air in the freezing chamber 53 can be supplied from the upper side to the lower side of the ice-making apparatus 30. A cool air inlet 621*a* for introducing cool air may be formed above the ice-making case 621.

Of course, the ice-making apparatus 30 is accommodated in the ice-making case 621 and the cool air is supplied from an evaporator (not illustrated) provided on the freezing chamber 53 or the rear wall surface of the freezing chamber 53 to cool the freezing chamber 53 is supplied to the cool air inlet, so that the ice-making can be more effectively performed.

At this time, the ice-making case 621 is not for heat insulation but for intensively supplying cool air and for covering the ice-making apparatus 30, and it can be said that the ice-making apparatus 30 and the ice bank 27 are in a state of being substantially cooled by the cool air in the freezing chamber 53.

An ice bank 27 may be provided under the ice-making case 621. The ice bank 27 is provided below the ice-making apparatus 30 and may store ice separated from the ice-making apparatus 30. The ice can be stored in the ice bank 27 so that the ice is maintained in the ice-fullness state by the ice-fullness detecting lever 36 of the ice-making apparatus 30.

At least a portion of the ice bank 27 becomes transparent so that the ice storage state of the ice can be visually confirmed when the freezing chamber door 62 is opened. The ice bank 27 can be configured to be detachable from the refrigerating chamber door 61 by a user's operation.

Meanwhile, in a case where a dispenser (not illustrated) is provided on the front surface of the freezing chamber door 62, the ice bank 27 and the dispenser are communicated with each other so that the ice stored in the ice bank 27 is taken out to the dispenser.

What is claimed is:

1. An ice-making apparatus for a refrigerator comprising:

an ice tray which is provided on a door and has a plurality of shells for making ice;

a water supplier configured to supply water to the ice tray;

an ice-fullness detecting lever which is provided below the ice tray and detects whether or not the ice which is separated from the ice tray by rotation thereof and stored is in a fullness state; and a driver coupled to the ice tray and the ice-fullness detecting lever and configured to rotate the ice tray and the ice-fullness detecting lever, a tray cover that is in contact with a periphery of the ice tray, that provides a cool air inlet into which cool air is introduced, that provides a lever disposition portion at a lower end of the tray cover, and that is provided above the ice tray, wherein the driver includes (i) a tray rotation shaft that is coupled to the ice tray at a side thereof and (ii) a lever rotation shaft that is coupled to the ice-fullness detecting lever below the tray rotation shaft, and wherein the ice-fullness detecting lever includes:

a connection portion that is connected to the lever rotation shaft and that extends in a direction away from the ice tray; and a detection unit that is bent at an extended end portion of the connection portion, that extends along a longitudinal direction of the ice tray at a lower side of the ice tray, and that is in contact with the ice at a height set by the rotation, wherein the lever disposition portion extends to a lower side of the tray cover and defines a space into which an upper end of the detection unit is accommodated, wherein the tray rotation shaft and the lever rotation shaft are disposed on a first surface of the driver, and wherein the ice-fullness detecting lever is provided in a plate shape, wherein, based on the ice-fullness detecting lever being oriented in a standby state, the detection unit is positioned inside the space defined by the lever disposition portion, and wherein, based on the ice-fullness detecting lever being rotated from the standby state, the detection unit is rotated to a lower side of the ice tray along an outside of the ice tray at a side of the ice tray.

2. The ice-making apparatus for a refrigerator according to claim 1, wherein a width of the detection unit is formed such that the ice-fullness detecting lever and the ice tray do not interfere with each other during the rotation operation thereof.

3. The ice-making apparatus for a refrigerator according to claim 1, wherein a part of the connection portion which is connected with the detection unit has a reinforcing portion which is thicker than a portion thereof connected to the lever rotation shaft.

4. The ice-making apparatus for a refrigerator according to claim 1, wherein an inner surface of the detection unit facing the connection portion is inclined or rounded in an up and down direction.

5. The ice-making apparatus for a refrigerator according to claim 1, wherein a distance from the ice tray to a first end of the detection unit is greater than a width of an upper end of the shell in a state where the ice-fullness detecting lever is rotated for detection.

6. The ice-making apparatus for a refrigerator according to claim 1, further comprising:

a reinforcing rib which protrudes along one end of the detection unit and starts to be in contact with the ice during the rotation of the ice-fullness detecting lever.

7. The ice-making apparatus for a refrigerator according to claim 1, wherein the driver is rotated with the ice-fullness detecting lever and the ice tray, and wherein the ice-fullness detecting lever starts rotating in a direction that the ice tray rotates.

8. The ice-making apparatus for a refrigerator according to claim 1, wherein an upper end of the detection unit is inserted into a space between an outer surface of the shell and an inner surface of the door before the rotation of the ice-fullness detecting lever starts, and wherein a lower end of the detection unit is rotated so as to be a minimum height from a lower side of the shell during the rotation of the ice-fullness detecting lever for detecting the ice-fullness.

9. The ice-making apparatus for a refrigerator according to claim 1, further comprising:

a freezing release member protruding toward the ice tray and provided on an inner surface of the detection unit facing the ice tray, wherein the freezing release member is in contact with the ice tray between the shells during the rotation of the ice tray.

10. The ice-making apparatus for a refrigerator according to claim 9, wherein, in a state where the ice tray is rotated by a set angle by the driver, the ice-fullness detecting lever starts rotating, and wherein, in a state where the ice-fullness detecting lever is stopped by freezing, based on the ice tray being rotated by the set angle, the freezing release member and the ice tray are in contact with each other.

11. The ice-making apparatus for a refrigerator according to claim 1, wherein the driver includes:

a driving case in which the tray rotation shaft and the lever rotation shaft protrude;

a motor disposed inside the drive case;

a plurality of transmission gears connected to the motor;

a tray rotation gear that is connected to a first side of the transmission gear and that has the tray rotation shaft;

a lever rotation gear in which the lever rotation shaft is formed; and a connection member configured to connect the transmission gear to the lever rotation gear, wherein the connection member starts rotation of the lever rotation gear in a state where the ice tray is rotated by a set angle.

12. The ice-making apparatus for a refrigerator according to claim 1, wherein the shell is formed so as to be widened from a lower side toward an upper side thereof, and wherein, in a stop state before the ice-fullness detecting lever starts the rotation thereof, at least a portion of the detection unit is accommodated in a space between an outer surface of the shell and an inside of the door.

13. The ice-making apparatus for a refrigerator according to claim 1, wherein the lever rotation shaft is positioned at an eccentric position with respect to the tray rotation shaft.

14. The ice-making apparatus for a refrigerator according to claim 1, wherein the door is a freezing chamber door which opens and closes a freezing chamber of the refrigerator.

* * * * *